US006967070B2

(12) United States Patent
Nakamura et al.

(10) Patent No.: US 6,967,070 B2
(45) Date of Patent: Nov. 22, 2005

(54) ELECTROPHOTOGRAPHIC TONER AND IMAGE FORMING METHOD

(75) Inventors: Yasushige Nakamura, Kawasaki (JP); Toru Takahashi, Kawasaki (JP); Tsuneo Watanuki, Kawasaki (JP); Norio Sawatari, Kawasaki (JP); Seijiro Ishimaru, Kawasaki (JP); Yasuyuki Furuse, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/987,464

(22) Filed: Nov. 14, 2001

(65) Prior Publication Data

US 2002/0136974 A1 Sep. 26, 2002

Related U.S. Application Data

(63) Continuation of application No. PCT/JP00/01678, filed on Mar. 17, 2000.

(30) Foreign Application Priority Data

Jul. 15, 1999 (WO) ..... PCT/JP99/03822

(51) Int. Cl.[7] ..... G03G 9/087

(52) U.S. Cl. ..... 430/108.4; 430/109.4; 430/108.8; 430/124

(58) Field of Search ..... 430/124, 108.4, 430/108.8, 109.4, 111.4

(56) References Cited

U.S. PATENT DOCUMENTS 4,578,338 A * 3/1986 Gruber et al. ..... 430/120
4,997,739 A * 3/1991 Tomono et al. ..... 430/108.8

(Continued)

FOREIGN PATENT DOCUMENTS

EP 0 707 239 4/1996
JP 63-66563 3/1988

(Continued)

*Primary Examiner*—Christopher Rodee
(74) *Attorney, Agent, or Firm*—Westerman, Hattori, Daniels & Adrian, LLP

(57) ABSTRACT

An electrophotographic toner comprising a binder resin and a colorant, which is used in electrophotographic process employing a flash fixing system for fixation of a transferred toner image, wherein the binder resin is a polyester resin which partially contains a chloroform-insoluble content; and the toner contains a polypropylene resin and an ester type structure resin represented by the following formula (I);

(I)

wherein p, q, m and n each represents a positive integer of 16 to 22 and R may be the same or different and each represents a hydrogen atom or a lower alkyl group having 1 to 4 carbon atoms. The electrophotographic toner is capable of remarkably enhancing the fixation strength of the toner and inhibiting the occurrence of voids during the printing and the occurrence of fuming and odor during the fixation.

22 Claims, 1 Drawing Sheet

U.S. PATENT DOCUMENTS

| | | | | | |
|---|---|---|---|---|---|
| 5,330,870 | A | | 7/1994 | Tanaka et al. | |
| 5,595,850 | A | | 1/1997 | Honjo et al. | |
| 5,618,648 | A | | 4/1997 | Horikoshi et al. | 430/109 |
| 5,691,096 | A | | 11/1997 | Baird et al. | |
| 5,741,617 | A | * | 4/1998 | Inaba et al. | 430/108.4 |
| 6,326,115 | B1 | * | 12/2001 | Nakanishi et al. | 430/109.5 |
| 6,335,139 | B1 | * | 1/2002 | Gambayashi et al. | 430/111.4 |
| 6,440,628 | B1 | * | 8/2002 | Watanabe et al. | 430/108.9 |

FOREIGN PATENT DOCUMENTS

| | | | | | |
|---|---|---|---|---|---|
| JP | 63-193155 | | | 8/1988 | |
| JP | 5-72812 | | | 3/1993 | |
| JP | 5-297626 | | | 11/1993 | |
| JP | 6-130851 | | | 5/1994 | |
| JP | 7-72657 | | | 3/1995 | |
| JP | 08-15892 | | | 1/1996 | |
| JP | 8-87128 | | | 4/1996 | |
| JP | 10-301332 | | | 11/1998 | |
| JP | 2001249486 | A | * | 9/2001 | G03G/9/08 |
| WO | WO99/23534 | | | 5/1999 | |
| WO | WO 9923534 | A1 | * | 5/1999 | G03G/9/087 |

* cited by examiner

ELECTROPHOTOGRAPHIC TONER AND IMAGE FORMING METHOD

CROSS-REFERENCE TO RELATED APPLICATIONS

This application is a continuation of PCT/JP00/01678, filed Mar. 17, 2000, which is based upon and claims the priority of PCT/JP99/03822, filed Jul. 15, 1999, the contents being incorporated herein by reference.

TECHNICAL FIELD

The present invention relates to an electrophotographic toner and, more particularly, to an electrophotographic toner, suitable for use in a flash fixing system, which can be used advantageously as a developing agent in various imaging apparatuses employing the electrophotographic system such as, for example, an electrophotographic copying machine, an electrophotographic printer and an electrostatic printing machine. The present invention also relates to an image forming method which employs the electrophotographic toner.

BACKGROUND ART

As is well known, the operation of an electrophotographic system, which has been widely used in copying machines, printers and printing machines, generally includes the following steps of:

(1) charging a photoconductive material;

(2) exposing the photoconductive material (formation of a latent image);

(3) developing the latent image with a developing agent (formation of toner image);

(4) transferring the toner image onto a recording medium; and (5) fixing the transferred toner image.

In the final fixing step (5), a heat roll fixing system which applies pressure to the toner by means of a heated fixing roller thereby to melt and fix the toner, and a flash fixing system which melts and fixes the toner by irradiating it with light such as flashlight are used.

The heat roll fixing system has such advantages that a cheap apparatus can be provided because the toner is fixed at high temperature under pressure and also the toner surface becomes smooth by pressing with a roller thereby making it possible to enhance the printing density. On the contrary, this fixing system has disadvantages in that the recording paper is curled due to high temperature after the fixation and an offset occurs because the fixing roller is stained with the toner and also has disadvantages in that it is difficult to achieve high speed operation due to curling of the paper and the toner is difficult to fix on a sealed post card whose surface is coated with glue.

On the other hand, the flash fixing system has various noticeable merits, although it has one problem in that a flash tube used as a light source has to be provided at a low price. The typical merits are as follows.

(1) The toner can be fixed on a recording medium without making contact because the toner is melted by exposure to light, and therefore curling of the recording paper and offset are eliminated, although the flash tube used as the light source is expensive, and therefore neither staining of the image (offset) during the contact fixation nor reduction of the resolution (spread of the image caused by passage through upper and lower rollers) is recognized.

(2) The degree of freedom with respect to design of the toner and fixing equipment is large because a specific design for prevention of stain of the image recognized during the contact fixation (for example, addition of wax as a releasant to the toner, application of silicone oil as a releasant onto the fixing roller or the like) is not required.

(3) Fixation can be achieved regardless of the kind (for example, material and thickness) of the recording paper to be used.

(4) High-speed recording can be achieved because neither curling of the recording paper nor offset occurs after the fixation, as described above, and the image can be fixed easily on a special recording paper such as a sealed post card.

In view of many advantages as described above, the flash fixing system has widely been employed in high-speed printers for business use and high-speed copying machines.

Describing the flash fixing system in more detail, hitherto, various electrophotographic toners have been specially designed and provided for flash fixation. For example, Japanese Unexamined Patent Publication (kokai) No. 5-107805 (corresponding to U.S. Pat. No. 5,330,870) discloses an electrophotographic toner for flash fixation which is less likely to cause odor, white smoke or the like due to decomposition and is capable of fixing without forming voids. This developing composition is characterized in that a polyester resin used as a binder resin is obtained from an acid component, 80 mol % of which is composed of a phthalic acid dicarboxylic acid, and an alcohol component, 80 mol % or more of which is composed of bisphenol A alkylene oxide adduct. Japanese Unexamined Patent Publication (kokai) No. 7-72657 discloses a toner, for an image forming apparatus, which is superior in flash fixability, environmental stability and void resistance. This toner is characterized in that a molecular weight distribution of a polyester polymer used as an essential constituent component has a plurality of molecular weight peaks. A similar toner is also disclosed in Japanese Unexamined Patent Publication (kokai) No. 8-123070. This toner for flash fixation is characterized in that it contains, as an essential constituent component of the toner, polyester and polyether, or polyester modified with polyether. Japanese Unexamined Patent Publication (kokai) No. 8-87128 discloses a toner for flash fixation, which is capable of achieving flash fixability and void resistance at the same time and is less likely to generate a fixation odor. This toner is characterized in that it contains, as a toner binder, a crosslinkable polyester resin using trimellitic acid and epi-bis type epoxy in combination as a crosslinking component, a number-average molecular weight of the resin being within a range from 2,000 to 4,000, a ratio of a weight-average molecular weight to a number-average molecular weight being within a range from 10 to 25.

As is understood from the above descriptions, it is important for the toner for flash fixation to achieve the flash fixability and void resistance at the same time and to eliminate or reduce an odor generated during the fixation. Therefore, a trial of improving the composition of the polyester resin used as the binder resin has been made to solve these problems in the conventional toners.

It has also been known to use a toner comprising a low viscosity polyester resin free from a chloroform-insoluble content in order to improve the flash fixability. However, when using such a toner, white defects (fine white dotted patterns) peculiar to flash fixation, which are called "voids", occur. The flash fixing system has a problem that, since the temperature of the toner surface is raised to 500° C. upon flash exposure, a low-molecular weight component included in the toner, which is liable to be sublimated, scatters thereto thereby to stain the inside a printing apparatus, resulting in clogging of a desmoking/deodorizing filter attached to the printing apparatus. In the conventional printing apparatuses, smoke is removed by attaching a desmoking/deodorizing filter made mainly of active carbon as a principal component in the vicinity of the fixation portion. However, current commercially available filters must be replaced frequently by a new filter because of their short lifetime. In a toner for flash fixation, an improvement in grinding efficiency in the preparation of the toner is required in view of stabilization and cost reduction of the developing agent. When using the toner in combination with the carrier, prevention of filming on the carrier is also required. If filming of the toner on the carrier can be prevented, it becomes possible to provide a developing agent stable for a long period.

DISCLOSURE OF THE INVENTION

An object of the invention is to provide an electrophotographic toner which can be used in an electrophotographic process employing a flash fixing system, which can realize a remarkable improvement in fixing strength of the tone and prevent the occurrence of voids peculiar to flash fixation and the occurrence of fuming and odor during the fixation, and also which can be prepared in an efficient and stable manner without causing stain of a printing apparatus and clogging of a desmoking/deodorizing filter due to sublimation of a toner component and provide a developing agent stable for a long period.

Another object of the invention is to provide an image forming method capable of sufficiently exhibiting the excellent operations and effects of the electrophotographic toner described above.

The objects described above and other objects of the present invention will become apparent from the following detailed description.

The present invention provides, in one aspect thereof, an electrophotographic toner comprising a binder resin and a colorant, which is used in electrophotographic process employing a flash fixing system for fixation of a transferred toner image, wherein the binder resin is a polyester resin which partially contains a chloroform-insoluble content; and the toner contains a polypropylene resin and an ester type resin represented by the following formula (I):

(I)

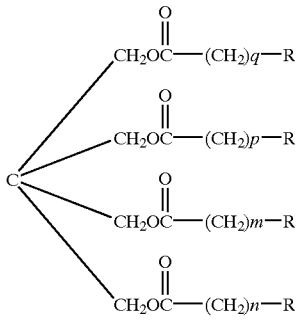

wherein p, q, m and n each represents a positive integer of 16 to 22 and R may be the same or different and each represents a hydrogen atom or a lower alkyl group having 1 to 4 carbon atoms.

The present invention provides, in another aspect thereof, an electrophotographic toner comprising a binder resin and a colorant, which is used in electrophotographic process employing a flash fixing system for fixation of a transferred toner image, wherein the binder resin is a polyester resin which contains an ester component represented by the following formula (XI):

(XI)

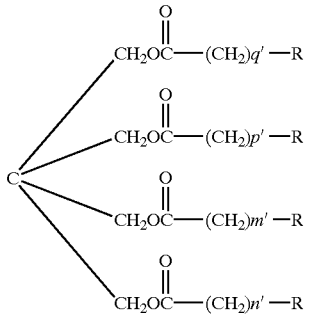

wherein p', q', m' and n' each represents a positive integer of 16 to 30 and R may be the same or different and each represents a hydrogen atom or a lower alkyl group having 1 to 4 carbon atoms, and contains at least a chloroform-insoluble content; and the toner optionally contains an ester type resin represented by the formula (XI).

The present invention provides, in a still another aspect thereof, an electrophotographic toner comprising a binder resin and a colorant, which is used in electrophotographic process employing a flash fixing system for fixation of a transferred toner image, wherein the binder resin is a polyester resin which contains an ester component represented by the above formula (XI) wherein R, p', q', m' and n' are as defined above, and contains at least a chloroform-insoluble content;

the polyester resin contains at least a resin containing the above ester component (XI) in the amount of 10% by weight or more; and the toner optionally contains an ester type resin represented by the above formula (XI).

The present invention provides, in a further aspect thereof, a method of forming an image according to an electrophotographic process which comprises the steps of forming an electrostatic latent image by image exposure, visualizing the electrostatic latent image by development, transferring the visualized image onto the recording medium and fixing the transferred image, wherein a developing agent containing the electrophotographic toner of the present invention is used in the step of developing the electrostatic latent image; and a flash fixing system is used as the toner fixing system in the step of fixing the toner image after transferring the toner image, which has been visualized by the use of the developing agent, onto the recording medium.

BEST MODE FOR CARRYING OUT THE INVENTION

Figure 1:
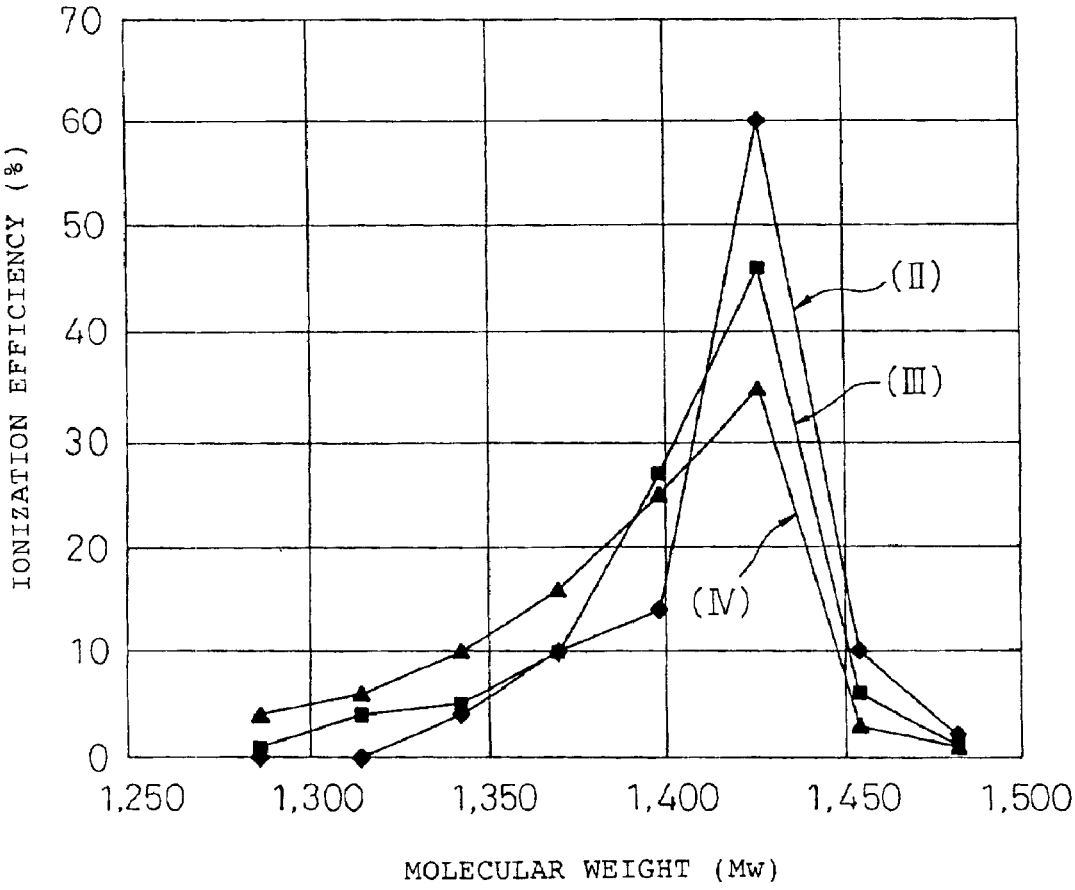
FIG. 1 is a graph showing a relationship between the molecular weight and the ionization efficiency of an ester type resin represented by the above formula (I) used in the present invention.

In order to develop an electrophotographic toner which has never been proposed the prior art, that is, an electrophotographic toner which is suited for use in a flash fixing system, remarkably improves the fixing strength of the tone and prevent the occurrence of voids peculiar to flash fixation (provided with void resistance) and the occurrence of fuming and odor during the fixation caused due to the composition of the toner, and also which does not cause stain of a printing apparatus and clogging of a filter due to sublimation of a toner component, the inventors have made careful studies. As a result, they have found that the following features are effective.

(1) use of a binder resin made of a specific polyester resin in combination with a polypropylene resin and a specific ester type resin represented by the formula (I);

(2) use of a binder resin made of a polyester resin, which contains a specific ester component and contains at least a chloroform-insoluble content; and (3) use of a binder resin made of a polyester resin, which contains a specific ester component and contains at least a chloroform-insoluble content, in combination with a resin which contains the ester component in the concentrated amount.

For easier understanding of the present invention, the toner having the feature (1) is hereinafter referred to as a "first toner of the present invention", the toner having the feature (2) is referred to as a "second toner of the present invention", and the toner having the feature (3) is referred to as a "third toner of the present invention". Further, for simplification of the description, a common matter in the first, second and third toners will not be described repeatedly.

As a principle, the electrophotographic toner of the present invention can have a composition similar to that of the toner which has conventionally been used in an electrophotographic method. That is, the toner of the present invention is composed of at least a binder resin and a colorant. As used herein, the term "ester type resin" refers to a resin of the above formula (I) or (XI). In the second and third toners of the present invention, the polyester resin used as the binder resin is a resin which contains an ester component and a chloroform-insoluble content and is referred to as an "ester component/chloroform-insoluble content-containing resin".

In the electrophotographic toner (first toner) of the present invention, the polyester resin used as the binder resin essentially contains a chloroform-insoluble content in a portion of its structure. The reason is that the chloroform-insoluble content in the binder resin can effectively prevent formation of voids during the fixation of the toner. This chloroform-insoluble content is originated from the raw material components of the polyester resin.

The polyester resin containing the chloroform-insoluble content can be used in different amounts in the toner, although it depends on the other resin components. The amount of the polyester resin can usually be defined by the amount of the chloroform-insoluble content based on the total amount of the toner. The polyester resin preferably contains the chloroform-insoluble content in the amount within a range from 3 to 20% by weight, and more preferably from 3 to 10% by weight. When the amount of the chloroform-insoluble content is smaller than 3% by weight, voids are liable to occur because the viscosity of the toner is reduced. On the other hand, when the amount is larger than 20% by weight, adhesion between the toner and the recording medium (for example, recording paper) and adhesion between toners are drastically inhibited. In the present invention, the fixing strength of the toner is evaluated by (1) adhesion between the toner and the recording paper and (2) adhesion between toners, while adhesion between the toner and the recording paper and adhesion between toners are measured by a peeling test for fixed images using an adhesive tape and a rubbing test for fixed images using an adhesive tape.

The polyester resin as the binder resin may be the same as a general-purpose polyester resin, although there is a limitation that the polyester resin must contain a chloroform-insoluble content in a portion of its structure. Suitable chloroform-insoluble content-containing polyester resin includes a polyester resin formed by polymerizing terephthalic acid, isophthalic acid or a mixture thereof as an acid component, an ethylene or propylene adduct of bisphenol A as an alcohol component and trimellitic acid as a crosslinking agent component. This polyester resin preferably has a glass transition temperature (Tg) of 60° C. or higher, along with a Tg of 58° C. or higher as the toner. When Tg of the toner is lower than 58° C., solidification is likely to occur under a high temperature environment during the transfer.

The polypropylene resin used in combination with the binder resin in the first toner of the present invention is not specifically limited as far as it does not exert an adverse influence on functions and effects of the present invention. The polypropylene resin preferably has a number-average molecular weight of 5,000 or more. When the molecular weight of the polypropylene resin is smaller than 5,000, the polypropylene resin is easily sublimated during the fixation and, therefore, it can not be used in the flash fixing system.

The polypropylene resin can be used in different amounts in the toner, although it depends on the other resin components. The amount of the polypropylene resin is preferably within a range from 0.1 to 5% by weight, and more preferably from 1 to 3% by weight. When the amount of the polypropylene resin is smaller than 0.1% by weight, the rubbing resistance can not be improved, although the resistance to peeling and the grindability of the toner can be improved. On the other hand, when the amount is larger than 5% by weight, problems such as staining of the apparatus and clogging of the filter occur because of sublimation.

The ester type resin of the formula (I) used in combination with the binder resin and the propylene resin in the first toner of the present invention includes various resins within the range defined by the general formula (I). Especially, a resin in which R in the formula may be the same and each represents a methyl group or an ethyl group can be used advantageously. The ester type resin, which can be used particularly advantageously, is a resin which is represented by the following general formula (II) and has a weight-average molecular weight within a range from 1,350 to 1,450.

(II)

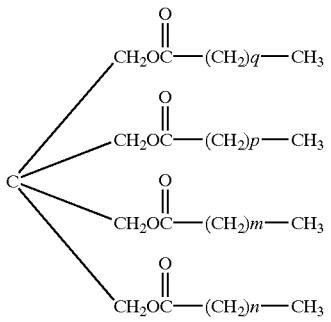

In the above formula, p, q, m and n are as defined above. In the ester type resin (II), when the molecular weight is smaller than 1,350 (that is, when the resin contains a resin as impurities), clogging of the filter is liable to occur. The reason is as follows. In the case of the ester type resin (I) used in the present invention, clogging of the filter tends to occur depending on a difference in molecular weight due to impurities.

The ester type resin (I) described above can be used in different amounts in the first toner, but the amount is preferably within a range from 0.5 to 15% by weight, and more preferably from 1 to 5% by weight. When the amount of the ester type resin (I) is smaller than 0.5% by weight, a satisfactory improvement in fixability cannot be achieved, although the resin itself has the effect of improving the fixability. On the other hand, when the amount is larger than 15% by weight, lowering of the grindability of the toner and clogging of the filter occur.

It is desired that the ester type resin (I) contains, as a principal component, a component having a molecular weight distribution within a range from 1,200 to 1,500 in a molecular weight distribution as determined by mass spectrometric analysis and also has one peak in this range, while an ionization efficiency of a high-molecular weight component having a molecular weight within a range from 1,420 to 1,430 is 45% or more and an ionization efficiency of a low-molecular weight component having a molecular weight of 1,350 or less is 10% or more. That is because the ester type resin (I) is liable to cause clogging of the filter due to a difference in molecular weight when it contains the low-molecular weight resin as impurities, and is also liable to cause clogging of the filter even if it contains impurities having a molecular weight of 1,350 or less. It is considered that the ester type resin (I), although it contains, as a principal component, a reaction product of pentaerythritol and tetraerucic acid ester, has a slight molecular weight distribution because tetraerucic acid ester contains molecules having a large number of carbon atoms and molecules having a small number of carbon atoms as impurities.

In the following Table 1 and the accompanying FIG. 1, the results of the molecular weight distribution of the ester type resin (II) and other ester type resins (III) and (IV), determined from a ratio of a peak height using a mass spectrograph (manufactured by JEOL Ltd. under the trade name of "SX102A"), are summarized.

TABLE 1

| | Ester type structure resin | | |
|---|---|---|---|
| Molecular weight (Mw) | (II) | (III) | (IV) |
| 1286 | 0 | 1 | 4 |
| 1314 | 0 | 4 | 6 |
| 1342 | 4 | 5 | 10 |
| 1370 | 10 | 10 | 16 |
| 1398 | 14 | 27 | 25 |
| 1426 | 60 | 46 | 35 |
| 1454 | 10 | 6 | 3 |
| 1482 | 2 | 1 | 1 |
| Total | 100 | 100 | 100 |

The first toner of the present invention preferably contains a chloroform-insoluble content-containing polyester resin, a polypropylene resin and an ester type resin (I) in the above ratio, as described above. Functions and effects of the respective resin components described above are synergistically combined with each other by adding a combination of the resins, thereby making it possible to simultaneously realize an improvement in fixability, reduction of voids, reduction of staining of the apparatus and clogging of the filter, and an improvement in grinding efficiency in the preparation of the toner.

In the first toner of the present invention, excellent functions and effects can be expected in characteristics (including characteristics during use) of the resulting toner, and the first toner may contain arbitrary binder resins (general-purpose binder resins), in addition to the combination of three kinds of the resins described above as far as any adverse influence is not exerted. Examples of suitable additional binder resin (general-purpose binder resin) include polyether-polyol resin, silicone resin, styrene resin, acrylic resin, styrene-acrylic resin, polyvinyl chloride resin, polyvinyl acetate resin, polyvinylidene chloride resin, phenol resin, and epoxy resin. When the amount of the additional binder resin is too large, an adverse influence is exerted on original characteristics of the resulting toner. Therefore, the amount is preferably within a range from about 20 to 30% by weight based on the total amount of the binder resin.

Describing with respect to the relation with the binder resin, in the first toner of the present invention, the binder resin included therein preferably has a glass transition temperature (Tg) of 60° C. or higher, and the glass transition temperature is preferably 58° C. or higher after the toner is prepared by mixing the binder resin and other toner components. When Tg of the toner is lower than 58° C., solidification is likely to occur due to an influence of high temperature during transportation of the toner.

The colorant to be dispersed in the binder resin in the first toner of the present invention includes various well-known dyes and pigments and can be arbitrarily selected and used according to the desired color tone in the toner. The preferred dyes and pigments used in the practice of the present invention include the followings:

various carbon blacks prepared by conventional methods such as thermal black method, acetylene black method, channel black method, and lamp black method, for example, lamp black (C.I. No.77266); grafted carbon black prepared by coating the surface of carbon black with a resin, for example, inorganic pigment such as iron black; and color dyes and pigments, for example, monoazo red pigment, disazo yellow pigment, quinacridone magenta pigment, anthraquinone dye, nigrosine dye, quaternary ammonium salt dye, and monoazo metal complex salt dye. Specific examples of these dyes and pigments with the color index number include Aniline Blue (C.I. No.50405), Chalco Oil Blue (C.I. No. Azoic Blue 3), Chrome Yellow (C.I. No.14090), Ultramarine Blue (C.I. No.77103), DuPon Oil Red (C.I. No.26105), Quinoline Yellow (C.I. No.47005), Methylene Blue Chloride (C.I. No.52015), Phthalocyanine Blue (C.I. No.74160), Malachite Green Oxalate (C.I. No.42000), and Rose Bengal (C.I. No.45435).

The dyes and pigments described above may be used alone or used in combination to obtain the desired color tone of the toner. The content of the colorant in the toner can vary according to the desired coloring effect, but is preferably within a range from 0.1 to 20% by weight, and more preferably from 0.5 to 10% by weight, based on the total amount of the toner in view of the coloring power during printing, shape retention of the toner and scattering of the toner in order to obtain the best toner characteristics.

The first toner of the present invention may contain various additives, in addition to the binder resins and colorants described above. For the purpose of improving the fluidity of the toner, the first toner may contain various inorganic fine particles as external additives. The inorganic fine particles, which can be used as the external additive in the present invention, usually have a primary particle diameter within a range from 5 nm to 2 $\mu$m, and more preferably from 5 to 500 nm. The surface area of the inorganic fine particles is preferably within a range from 20 to 500 $m^2/g$ in terms of a specific surface area as measured by the BET method.

Examples of suitable inorganic fine particles in the practice of the present invention include, but are not limited to, fine particles of silica, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these fine particles, fine powders of silica can be used advantageously.

The inorganic fine particles can be added externally to the toner in different amounts, but are preferably used in the amount within a range from 0.01 to 5.0% by weight, and more preferably from 0.01 to 2.0% by weight, based on the total amount of the toner.

In the toner of the present invention, other conventional external additives, for example, fine fluoroparticles and resin particles such as fine acrylic resin particles may be used, in addition to the inorganic external additives.

The first toner of the present invention may contain charge controlling agents, which are commonly used in this technical field, for the purpose of controlling the chargeability of the toner. Suitable examples of the charge controlling agent include an electron donating substance such as a nigrosine dye, a fatty acid metal salt, a quaternary ammonium salt or the like in case of the positively-charged toner, or an electron accepting substance such as an azo metal-containing dye, a chlorinated paraffin, a chlorinated polyester or the like in case of the negatively-charged toner.

Furthermore, the electrophotographic toner of the present invention can contain, as a releasant or an anti-offset agent, various general-purpose waxes such as low-molecular weight polypropylene wax or polyethylene wax, carnauba wax, montan wax, amide wax or the like. If the toner of the present invention is used in an electrophotographic process which employs a flash fixing system, polypropylene wax is advantageously used to avoid clogging of the filter due to sublimation during the flash fixation.

Summarizing the description of the first toner, in the practice of the present invention the toner components described above can be used in the following ratio based on the total amount of the toner.

| | |
|---|---|
| Chloroform-insoluble content-containing polyester resin | 50 to 95% by weight |
| Polypropylene resin | 0.1 to 5% by weight |
| Ester type resin | 0.5 to 15% by weight |
| Colorant | 0.1 to 20% by weight |
| Charge controlling agent | 1 to 5% by weight |
| Wax | 0 to 5% by weight |
| External additive | 0 to 5% by weight |

If necessary, the amount of these toner components may be larger or smaller than the above range.

The electrophotographic toner of the present invention also includes the second and third toners, in addition to the first toner described above. As described previously, in the second and third toners, a polyester resin, which contains an ester component represented by the formula (XI) and at least a chloroform-insoluble content, is used as the binder resin. In these toners of the present invention, excellent fixability and void resistance are achieved at the same time by using a specific ester component/chloroform-insoluble content-containing polyester resin as a constituent component of the binder resin. The grindability in the preparation of the toner can be improved by incorporating a polypropylene resin into the toner, in addition to such a specific polyester resin. If necessary, these toners preferably contain an ester type resin represented by the formula (XI), which is similar to the resin of the formula (I). As is apparent from the following description, these toners are similar to the first toner in the basic composition but are different in the composition of the binder resin, and are characterized in that the ester component of the formula (XI) is added to the polyester resin during the polymerization reaction step.

In the second and third toners of the present invention, the ester component of the formula (XI), which constitutes the polyester resin used as the binder resin, can include various ester components within the range defined in the general formula (XI). Especially, an ester component in which each R is the same and each represents a methyl group or an ethyl group can be advantageously used. An ester component, which can be used particularly advantageously, is an ester component represented by the following formula (XII).

(XII)

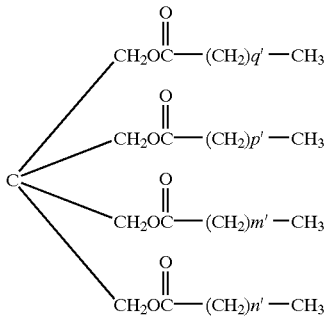

In the above formula, p', q', m' and n' are as defined above.

Since such an ester component (XII) is liable to cause clogging of the filter due to a difference in molecular weight, depending on impurities, the weight-average molecular weight is preferably within a range from 1,200 to 2,200 (based on the molecular weight distribution as determined by mass spectrometric analysis). When the molecular weight of this ester component is smaller than 1,200 (i.e., when the ester component contains the resin as impurities), clogging of the filter is liable to occur. If the ester component contains impurities having a molecular weight of 1,000 or less, clogging of the filter becomes more severe. Although the ester type resin contains, as a principal component, a reaction product of pentaerythritol and tetraerucic acid ester, it has a slight molecular weight distribution because tetraerucic acid ester contains molecules having a large number of carbon atoms and molecules having a small number of carbon atoms as impurities. Such an ester component has at least one maximum peak in a molecular weight distribution within a range from 1,200 to 2,200, while the ionization efficiency of the maximum peak is preferably 45% or more based on the entire component.

In the second and third toners of the present invention, an ester component, which can be used particularly advantageously, is an ester component represented by the following formula (XIII).

(XIII)

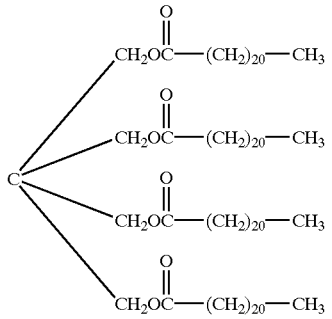

In a specific structure polyester resin used in the present invention, the ester component of the formula (XI) contained in the molecule is preferably introduced during the polymerization reaction step of the polyester resin. The polyester component (XI) can be introduced into the polyester resin by adding it at arbitrary stage (timing) of the polymerization reaction step. For example, it may be a stage where a monomer of the polyester resin is added at the initial polymerization reaction step, or a stage where the polymerization is positively carried out. Alternatively, it may be a final stage of the polymerization reaction step where the polymerization has entered the last stage.

In the practice of the present invention, the ester component/chloroform-insoluble content-containing polyester resin contains the ester component and chloroform-insoluble content described above. Such a polyester resin can contain these components in an arbitrary amount, and the amount of the ester component is preferably within a range from 0.1 to 10% by weight, and more preferably from 0.5 to 5% by weight, based on the total amount of the toner. The amount of the chloroform-insoluble content is preferably within a range from 3 to 20% by weight, and more preferably from 3 to 10% by weight, based on the total amount of the toner.

As described above, the toner of the present invention contains the polypropylene resin, and the amount of the polypropylene resin is preferably within a range from 0.1 to 5% by weight, and more preferably from 0.1 to 3% by weight, based on the total amount of the toner.

In the toner of the present invention, improvement in fixability, reduction of voids, reduction of stain of the apparatus (clogging of the filter and others), improvement in grinding efficiency in the preparation of the toner and prevention of filming to the carrier can be simultaneously realized by using in combination the components described above in the amount described above.

When the amount of the ester component of the formula (XI) is smaller than 0.1% by weight based on the total amount of the toner, the effect of improving the fixability cannot be expected. On the other hand, when the amount is larger than 10% by weight, lowering of the grindability of the toner and clogging of the filter occur. As described above, clogging of the filter is also liable to occur depending on a difference in the molecular weight caused by the presence of impurities.

When the amount of the chloroform-insoluble content in the polyester resin is smaller than 3% by weight based on the total amount of the toner, the resulting toner has low viscosity and voids are liable to occur. On the other hand, when the amount is larger than 20% by weight, adhesion between the toner and a medium such as recording paper and adhesion between toners are inhibited.

When the amount of the polypropylene resin added additionally to the toner is smaller than 0.1% by weight based on the total amount of the toner, although an improvement in peeling resistance and grindability of the toner can be expected, the rubbing resistance cannot be improved. On the other hand, when the amount is larger than 5% by weight, the flash fixing system cannot be employed because the resin itself is sublimated. When using the polypropylene resin, the molecular weight is also important, in addition to the amount added, and the polypropylene resin preferably has a number-average molecular weight of 5,000 or more. Such a polypropylene resin is usually in the form of wax.

Describing in more detail, in the second and third toners of the present invention, introduction of the above-described ester component to the specific structure polyester resin (binder resin) enables improvement in the compatibility of the binder resin and a reduction in filming of the toners to the carrier.

Since the ester component represented by the formula (XI) originally has poor compatibility with the polyester resin, it is difficult to disperse the ester resin in the preparation of the toner, resulting in severe filming on the surface of the carrier. Although the dispersion can be controlled to some extent by applying a shear force in the kneading step, uniform dispersion cannot be achieved by this method. To remove these disadvantages of the prior art, in the second and third toners of the present invention, the ester component is introduced into the structure of the polyester resin in the stage of preparing the binder resin, i.e. the stage of polymerizing the polyester resin, to thereby improve the dispersibility and, at the same time, disperse substantially uniformly the ester component in the entire polyester resin, thus making it possible to maintain the fixability and to effectively prevent filming of the carrier.

As in the third toner of the present invention, the dispersibility can be effectively improved by polymerizing or mixing 10% or more of an ester component with a polyester resin to prepare a resin as a masterbatch, followed by mixing the polyester resin formed into the masterbatch with a new polyester resin at the stage of the resin, or mixing the both at the stage of preparing the toner. In case an ester component is further incorporated in the preparation of the toner using a polyester resin prepared by adding the ester component in the resin, the dispersibility can be markedly improved as compared with the case of adding the ester resin in the preparation of the toner. The reason is considered as follows. That is, since the ester component added in the polyester resin has compatibility with the resin, the compatibility with the resin is generally improved by the affinity with the ester added at a later stage and further the micell effect.

The ester component described above can exist in the state of being dispersed in a specific structure polyester resin as the binder resin. In such a case, the ester component can be dispersed in a wide range of particle diameters, but is preferably dispersed in the particle diameter of 5 $\mu$m or less. Since the particle diameter becomes smaller in the preparation of the toner when the ester component has such a particle diameter, the dispersion of the ester component of the resulting toner is improved and filming to the carrier is inhibited and, thereby, it becomes possible to obtain a toner having excellent fixability. As used herein, the term "dispersion particle diameter" refers to an average particle diameter of the ester component dispersed in the polyester resin and can be determined by slicing a polyester resin particle having a diameter of about 1 mm using a microtome, observing the resulting piece of thin foil having a thickness within a range from 0.1 to 0.5 μm, and image-analyzing the results (image data) using a well-known method. As the microscope for observation, for example, a transmission type optical microscope (manufactured by OLYMPUS OPTICAL CO., LTD. under the trade name of "BH-2") and a transmission type optical scanning microscope (manufactured by JEOL Ltd. under the trade name of "JEM2010") can be used.

In the second and third toners of the present invention, excellent functions and effects can be expected in characteristics (including characteristics when used) of the resulting toner and the second, and the third toner may contain additional binder resins, as in the first toner described above, as far as any adverse influence is not exerted. Suitable additional binder resin is an ester type resin of the formula (XI). As in the ester type resin of the above formula (I), this resin is a polyester resin formed by polymerizing terephthalic acid, isophthalic acid or a mixture thereof as an acid component, an ethylene or propylene adduct of bisphenol A as an alcohol component and trimellitic acid as a crosslinking agent component. This polyester resin preferably has a glass transition temperature (Tg) of 60° C. or higher and shows Tg of 58° C. or higher in the form of the toner. When Tg of the toner is lower than 58° C., solidification is likely to occur under a high temperature environment during the transportation of the toner.

The additional binder resin may be a general-purpose binder resin. Examples of suitable additional binder resin include polyester resin, polyether-polyol resin, silicone resin, styrene resin, acrylic resin, styrene-acrylic resin, polyvinyl chloride resin, polyvinyl acetate resin, polyvinylidene chloride resin, phenol resin, and epoxy resin. These binder resins can be used alone or in combination. When the amount of the additional binder resin is too large, an adverse influence in exerted on original characteristics of the resulting toner. Therefore, the amount is preferably within a range from about 20 to 30% by weight based on the total amount of the binder resin.

As in the first toner described above, the colorant to be dispersed in the binder resin in the second and third toners of the present invention includes various well-known dyes and pigments and can be arbitrarily selected and used according to the desired color tone in the toner. See, the description of the first toner with respect to suitable dyes and pigments suited for use in the present invention.

The dyes and pigments as the colorant may be used alone or used in combination to obtain the desired color tone of the toner. The content of the colorant in the toner can vary according to the desired coloring effect, but is preferably within a range from 0.1 to 30 parts by weight, more preferably from 0.5 to 22 parts by weight, and most preferably from 5 to 20 parts by weight, based on 100 parts by weight of the toner in view of the coloring power during printing, shape retention of the toner and scattering of the toner in order to obtain the best toner characteristics.

As in the first toner described above, the second and third toners of the present invention may contain various additives, in addition to the binder resins and colorants described above. For example, for the purpose of improving the fluidity of the toner, the second toner may contain various inorganic fine particles as external additives. The inorganic fine particles, which can be used as the external additive in the present invention, usually have a primary particle diameter within a range from 5 nm to 2 μm, and more preferably from 5 to 500 nm. The surface area of the inorganic fine particles is preferably within a range from 20 to 500 $m^2/g$ in terms of a specific surface area as measured by the BET method. The size of the inorganic fine particles used herein can be the same as the size of those used in the first toner.

Similarly, inorganic fine particles suitable for the second and third toners can be the same as those used in the first toner. Suitable inorganic fine particles include silica, alumina and titanium oxide, and fine powders of silica can be advantageously used. These inorganic fine particles can be added externally to the toner in different amounts, but are preferably used in the amount within a range from 0.01 to 5 parts by weight, and more preferably from 0.01 to 2 parts by weight, based on 100 parts by weight of the toner.

As in the first toner, in these second and third toners, other conventional external additives, for example, fluorine fine particles and resin particles such as acrylic fine resin particles may be used, in addition to the inorganic external additives. Similar to the first toner, the second and third toners of the present invention may contain charge controlling agents, which are commonly used in this technical field, for the purpose of controlling the chargeability of the toner and may also contain various general-purpose waxes as a releasant or an anti-offset agent (see, the above description). As described previously, when using this second toner in an electrophotographic process employing a flash fixing system, polypropylene wax is advantageously used to avoid clogging of the filter due to sublimation during the flash fixation.

Summarizing the description of the second and third toners, in the practice of the present invention, the toner components of the second toner described above can be used in the following ratio based on the total amount of the toner.

| | |
|---|---|
| Ester component/chloroform-insoluble content-containing polyester resin | 50 to 95% by weight |
| Polypropylene resin | 0.1 to 5% by weight |
| Ester type resin | 0 to 10% by weight |
| Colorant | 0.1 to 20% by weight |
| Charge controlling agent | 1 to 5% by weight |
| Wax | 0 to 5% by weight |
| External additive | 0 to 5% by weight |

If necessary, the amount of these toner components may be larger or smaller than the above range. In addition, the third toner contains, in the polyester resin, at least a resin containing 10% or more of the ester component described above, in addition to the toner components described above.

The electrophotographic toner (first, second and third toners) of the present invention can be prepared according to various procedures using the toner components described above as the starting materials. For example, the toner of the present invention can be prepared by employing a well-known method such as mechanical grinding and a classifying process where resin blocks with a colorant or the like dispersed therein are ground and classified, or a polymerization method where a monomer is polymerized while mixing a colorant or the like therein thereby forming fine particles. The toner of the present invention is preferably prepared by the mechanical grinding method and, advantageously, in the procedure described below.

The first toner can be advantageously prepared by the following non-limiting procedure.

(1) Mixing of Materials

A binder resin (chloroform-insoluble content-containing polyester resin, polypropylene resin and ester type structure resin), a colorant, a charge controlling agent and the like are weighed and mixed uniformly in a powder mixing machine. For the powder mixing machine, for example, a ball mill or the like can be used. The colorant, the charge controlling agent, etc. are dispersed uniformly in the resin binder.

(2) Melt Kneading

The mixture thus obtained is heated to melt and is kneaded by using a screw extruder (extruder), roll mill, kneader or the like. The colorant particles are changed into fine particles and at the same time the components are dispersed uniformly.

(3) Solidification with Cooling

After the completion of the kneading, the kneaded mixture is solidified by cooling.

(4) Grinding

The solidified mixture is first ground into coarse particles with a coarse grinder such as hammer mill or cutter mill, and then ground into fine powder with a finer grinder such as jet mill.

(5) Classification

The fine powder made by fine grinding is classified so as to remove particles which are too small and could result in lower fluidity of the toner and scattering of the toner, and particles which are too large and result in degradation of picture quality. For example, a wind classifier that utilizes a centrifugal force may be used as a classification apparatus to obtain a toner in the form of desired spherical fine particles having an average particle diameter within a range from about 0.5 to 50 μm, and preferably from about 1 to 15 μm.

(6) Surface Treatment

In the last step, the toner particles may be coated with hydrophobic silica or titanium oxide, or with another additive added as required, for the purpose of improving the fluidity of the toner. A high speed flow mixer may be used in the surface treatment.

The second and third toners can also be prepared advantageously by the same procedure as in the above method of preparing the first toner.

The toner of the present invention may be either a magnetic toner or a non-magnetic toner, and a developing system using the same may be either a two-component system using a toner and a carrier or a one-component system using only a toner. In a high speed printer, the two-component system can be advantageously used in view of its long life.

In the case of the toner for use in the two-component system, various carrier materials such as iron powders and ferrite powders are well known as the carriers, to be used in combination with the toner, in this technical field. In the practice of the present invention, a material obtained by coating a core material can be advantageously used as the carrier in order to develop more satisfactorily. As the core material of the carrier, for example, a manganese-strontium (Mn—Sr) or manganese-magnesium (Mn—Mg) material having about 65 to 75 emu/g is most preferred. Highly magnetized (about 200 emu/g) iron powders and magnetite (about 90 emu/g) are preferred in view of security of the image density, although striation may occur in the print. A copper-zinc (Cu—Zn) material having low magnetization intensity (about 60 emu/g) is preferred because the carrier is liable to be deposited.

The core material of the carrier is preferably used in the form of particles and the average particle of the core material in the form of particles is preferably within a range from 20 to 100 μm, and more preferably within a range from 60 to 90 μm. When the average particle of the core material in the form of particles is smaller than 20 μm, the content of fine powders increases in the distribution of the carrier particles and the magnetization intensity per one carrier particle is reduced, resulting in scattering of the carrier. On the other hand, when the average particle of the core material in the form of particles is larger than 100 μm, the specific surface area is reduced, resulting in scattering of the toner. In case of full color printing with a substantial solid portion, reproduction of the solid portion becomes poor.

The coating to be formed on the carrier core material is preferably resin coating, and more preferably coating made of a silicone resin or a modified silicone resin, because the silicone resin or modified silicone resin can contribute to a long life of the carrier. Furthermore, the silicone resin or modified silicone resin may be used alone or in combination. To achieve prolongation of the life, an additional component is preferably added to the silicone resin or modified silicone resin. Examples of suitable additional additive include nigrosine and a complex thereof, and a compound such as sodium stearate may further added to such a component.

The amount of the coating of the silicone resin or modified silicone resin can vary widely depending on the desired effects, and is usually within a range from 0.1 to 5.0% by weight, preferably from 0.15 to 2.0% by weight, and more preferably from 0.8 to 1.5% by weight, based on the total amount of the core material coated with the resin. When the amount of the resin coating is smaller than 0.1% by weight, a uniform resin coating can not be formed on the surface of the carrier if the surface area index of the carrier core material used in the present invention is within a range from 1.0 to 2.1. On the other hand, when the amount of the resin coating is larger than 5.0% by weight, the resin coating becomes too thick and thus granulation of carrier particles occurs and uniform carrier particles cannot be obtained.

The resin coating can be formed on the surface of the carrier core material according to various methods. Preferably, a resin solution prepared by dissolving a silicone resin, a modified silicone resin and an additional component such as nigrosine, which is optionally added, in an appropriate solvent, can be applied on the surface. Examples of the solvent, which can be used to prepare the resin solution, include toluene, xylene, methyl ethyl ketone, methyl isobutyl ketone, and butylcellosolve acetate. These solvents may be used alone or in combination.

After the completion of formation of the resin coating, the solvent is vaporized by drying and the resin coating is baked. The baking device may be either an external heating device or an internal heating device and, for example, a fixed or flow type electric furnace, a rotary electric furnace, and a burner furnace can be used. A baking device utilizing microwaves may be used. The baking temperature is preferably within a range from 180 to 300° C., and more preferably from 220 to 280° C. When the baking temperature is lower than 180° C., the resin coating cannot be sufficiently solidified. On the other hand, when the baking temperature is higher than 300° C., the resin itself is partially decomposed and thus the surface layer of the resin is roughened and a uniform resin coating cannot be obtained.

The present invention provides, in a still further aspect thereof, a method of forming an image by using an electrophotographic process. This image forming method includes the steps of (1) forming an electrostatic latent image by image exposure, (2) visualizing the electrostatic latent image by development, (3) transferring the visualized image onto the recording medium and (4) fixing the transferred image, as described previously, and is particularly characterized in that:

1. a developing agent containing an electrophotographic toner (first, second or third toner) is used in the step (2) of developing the electrostatic latent image, and 2. a flash fixing system is used as the toner fixing method in the step (4) of fixing the image after transferring the image, which has been visualized by the use of the developing agent, onto the recording medium.

The image forming method of the present invention can be carried out by using procedures and apparatuses, which have conventionally been used in the prior art. Typical procedure for formation of the image includes the following steps:

Charging of Photosensitive Material:

The surface of a photoconductive insulator such as a photosensitive drum is charged with positive or negative electrostatic charge. Examples of the photoconductive material include inorganic photoconductive material such as amorphous silicon or selenium and organic photoconductive material such as polysilane or phthalocyanine.

Exposure of Photosensitive Material (Formation of Latent Image):

After the completion of a uniform charging step, the electrostatic charge on the insulating material is partially erased by irradiating the photoconductive insulator with light with any of various means, thereby forming an electrostatic latent image. For example, the surface charge can be erased from specific portions by irradiating with laser beam, so as to form the electrostatic latent image on the photoconductive insulator according to the image information. A so-called "back light system" in which developing is made by irradiating the portion to be developed with light from the back surface of the photoconductive insulator may be employed.

Development of Latent Image with Toner:

Then the electrostatic latent image thus formed is visualized by depositing the fine powder of the toner (developing agent) on the latent image portion where the electrostatic charge remains on the photoconductive insulator. As previously described, this developing system may be either a one-component system or a two-component system. Thus, a toner image can be obtained. Transfer of toner image onto recording medium:

The visualized image is electrostatically transferred onto the recording medium such as recording paper to obtain a print.

Fixation of Transferred Toner Image:

The toner image transferred electrostatically onto the recording medium is melted and fixed by the flash fixing system. Although conditions of flash fixation can vary widely, it is preferred to set the energy of flashtube within a range from 0.5 to 3.0 J/cm$^2$ and to set duration of the flashlight within a range from 500 to 3,000 $\mu$s. The reason why the energy of flashlight and duration of the flashlight should be controlled as described above is as follows. That is, when the energy of flashlight is too large and the duration of the flashlight is too long, the paper as the recording paper is likely to burn when using a toner having good fixability. According to the image forming method of the present invention, comparable operations and effects can be obtained even when using a heat roll fixing system and other fixing systems in place of the flash fixing system because of fixation of the transferred toner image.

EXAMPLES

The present invention will be further described with reference to the examples thereof. In the following examples, parts are by weight unless otherwise specified. Amounts of the respective toner components and carrier components described in Tables 2 to 4 are expressed in parts by weight.

Example 1

Preparation of Toner 1:

As described in Table 2 below, the following toner components were prepared in the amount described below.

| | |
|---|---|
| Polyester resin containing 5% by weight of chloroform-insoluble content (propylene oxide adduct of bisphenol A, prepared by using terephthalic acid and trimellitic acid as a raw material component, grass transition temperature: 62 to 66° C., acid value: about 20 mg KOH/g, manufactured by Kao Corp.) | 84 parts |
| Polypropylene resin (weight-average molecular weight: 10,000, 2 parts, manufactured by Mitsui Chemicals under the trade name of "NP105") | 2 parts |
| Ester type resin (II) (see the following formula, manufactured by Nippon Oil & Fats Co., Ltd.) | 3 parts |

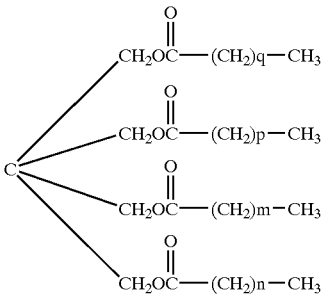

| | | |
|---|---|---|
| Colorant | Carbon (#25, manufactured by Mitsubishi Chemical) | 10 parts |
| Charge controlling agent | Sulfonic acid polymer (manufactured by Hodogaya Chemical CO., Ltd. under the trade name of "T-95") | 1 part |

These toner components were preliminary mixed by charging in a ball mill and then the mixture was melted and kneaded in an extruder heated to 160° C. After cooling the kneaded mixture to solidify, the solid mixture was ground by a hammer mill and then ground into a fine powder in a jet Mill. The fine powder thus obtained was classified by an air flow classifier, thereby to obtain black fine spherical particles having a volume-average particle diameter of 8.5 $\mu$m. To the fine particles of toner thus obtained, 1.5 parts by weight of hydrophobic fine silica particles (manufactured by Clariant Japan Co., Ltd. under the trade name of "H2000/4") were externally added in a Henschel mixer. As a result, an yellow toner in the form of fine spherical particles having an average particle diameter of 8.5 $\mu$m was obtained. The resulting toner in the form of fine spherical particles is referred to as "toner 1", hereinafter.

Example 2

Preparation of Toners 2 to 31:

The same method as in Example 1 was repeated to prepare toners in the form of fine spherical particles. In these examples, as described in Tables 2 and 3 described hereinafter, combinations and amounts of toner components were changed. Change points of the respective toners are summarized as follows.

| | |
|---|---|
| "Toner 2" | |
| Chloroform-insoluble content in polyester resin | 10% by weight |
| "Toner 3" | |
| Chloroform-insoluble content in polyester resin | 20% by weight |
| "Toner 4" | |
| Chloroform-insoluble content in polyester resin | 30% by weight |

-continued

"Toner 5"

| | |
|---|---|
| Chloroform-insoluble content in polyester resin | 3% by weight |

"Toner 6"

| | |
|---|---|
| Polyester resin | 85.5 parts |
| Chloroform-insoluble content in polyester resin | 2% by weight |
| Polypropylene resin | 0.5 parts |

"Toner 7"

| | |
|---|---|
| Polyester resin | 85.5 parts |
| Polypropylene resin | 0.5 parts |

"Toner 8"

| | |
|---|---|
| Polyester resin | 85.99 parts |
| Polypropylene resin | 0.01 parts |

"Toner 9"

| | |
|---|---|
| Polyester resin | 81 parts |
| Polypropylene resin | 5 parts |

"Toner 10"

| | |
|---|---|
| Polyester resin | 79 parts |
| Polypropylene resin | 7 parts |

"Toner 11"

| | |
|---|---|
| Polyester resin | 86 parts |
| Ester type resin (II) | 1 part |

"Toner 12"

| | |
|---|---|
| Polyester resin | 86.5 parts |
| Ester type resin (II) | 0.5 part |

"Toner 13"

| | |
|---|---|
| Polyester resin | 72 parts |
| Ester type resin (II) | 15 part |

"Toner 14"

| | |
|---|---|
| Polyester resin | 67 parts |
| Ester type resin (II) | 20 part |

"Toner 15"

| | |
|---|---|
| Ester type resin (III) | 3 parts |

"Toner 16"

| | |
|---|---|
| Ester type resin (IV) | 3 parts |

"Toner 17"

| | |
|---|---|
| Polyester resin | 79 parts |
| Chloroform-insoluble content in polyester resin | 10% by weight |
| Magnetic powder (manufactured by Kanto Denka Kogyo Co., Ltd. under the trade name of "KEP-S") | 5 parts |

"Toner 18"

| | |
|---|---|
| Polyester resin | 42 parts |
| Chloroform-insoluble content in polyester resin | 10% by weight |
| Polyether polyol resin (manufactured by Mitsui Chemicals) | 42 parts |

"Toner 19"

| | |
|---|---|
| Polyester resin | 42 parts |
| Chloroform-insoluble content in polyester resin | 10% by weight |
| Styrene-acrylic resin (manufactured by Mitsui Chemicals) | 42 parts |

"Toner 20"

| | |
|---|---|
| Polyester resin | 85 parts |
| Magenta pigment (manufactured by Dainichiseika Color & Chemicals Mfg. Co., Ltd. under the trade name of "ECR181") | 10 parts |

"Toner 21"

| | |
|---|---|
| Comparative ester type resin (V) (see the following formula, manufactured by Nippon Oil & Fats Co., Ltd.) | 3 parts |

-continued (V)

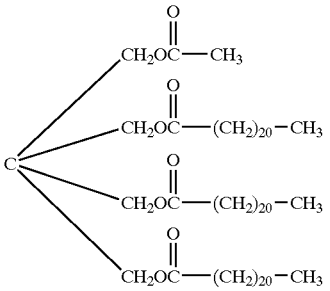

"Toner 22" 3 parts

Comparative ester type resin (VI) (see the following formula, manufactured by Nippon Oil & Fats Co., Ltd.)

(VI)

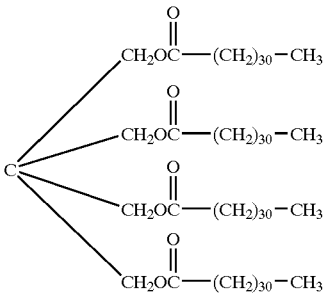

"Toner 23" 3 parts

Montan wax (manufactured by Clariant (Japan) K. K. under the trade name of "KP302")
"Toner 24" 3 parts Montan wax (manufactured by Clariant (Japan) K. K. under the trade name of "OP")
"Toner 25" 3 parts Polyethylene wax (number-average molecular weight: 900, manufactured by Mitsui Chemicals under the trade name of "100P")
"Toner 26" 3 parts Polyethylene wax (manufactured by Clariant (Japan) K.K. under the trade name of "PE520")
"Toner 27"

Carnauba wax (manufactured by Kato Yoko K. K.) 3 parts
"Toner 28"

Amide wax (manufactured by Clariant (Japan) K. K. under the trade name of "9615A") 3 parts
"Toner 29" 2 parts Polyepropylene wax (number-average molecular weight: 4,000, manufactured by Sanyo Chemical Ind. under the trade name of "550P")
"Toner 30" 2 parts Polyepropylene wax (number-average molecular weight: 3,000, manufactured by Sanyo Chemical Ind. under the trade name of "660P")
"Toner 31" 3 parts Polyethylene wax (number-average molecular weight: 8,000, manufactured by Mitsui Chemicals Ind. under the trade name of "800P")

Example 3

Preparation of Carrier 1:

Manganese-strontium (Mn—Sr) ferrite particles (Powdertech Co.) having an average particle diameter of 80 μm as a carrier core material were prepared and then the surface of this core material was coated with a silicone resin (solid content: 20% by weight, manufactured by TORAY DOW CORNING SILICONE CO., LTD. under the trade name of "SR2411") containing a mixture of a nigrosine complex and sodium stearate (manufactured by Orient Chemical Industries Co., Ltd. under the trade name of "N-11") in a coating weight of 0.1% by weight using a fluidized bed. After the completion of coating, the coated core material was baked at a temperature of 250° C. for three hours. As a result, a Mn—Sr ferrite carrier coated with a silicone resin was obtained. The resulting carrier is referred to as "carrier 1", hereinafter.

Example 4

Preparation of Carriers 2 to 12:

The same method as in Example 3 was repeated to prepare carriers coated with a resin. In these examples, as described in Table 4 described hereinafter, core materials and coating agents of carrier components were changed. Change points of the respective carriers are summarized as follows.

| | |
|---|---|
| "Carrier 2" | |
| Silicone resin | 99.5 parts |
| Mixture of nigrosine complex and sodium stearate | 0.5 parts |
| "Carrier 3" | |
| Silicone resin | 99 parts |
| Mixture of nigrosine complex and sodium stearate | 1 part |
| "Carrier 4" | |
| Silicone resin | 98 parts |
| Mixture of nigrosine complex and sodium stearate | 2 parts |
| "Carrier 5" | |
| Silicone resin | 95 parts |
| Mixture of nigrosine complex and sodium stearate | 5 parts |
| "Carrier 6" | |
| Silicone resin | 100 parts |
| "Carrier 7" | |
| Silicone resin | 99 parts |
| Nigrosine (manufactured by Orient Chemical Industries Co., Ltd. under the trade name of "EX") | 1 part |
| "Carrier 8" | |
| Silicone resin | 99.5 parts |
| Nigrosine (manufactured by Orient Chemical Industries Co., Ltd. under the trade name of "EX") | 0.5 parts |
| "Carrier 9" | |
| Silicone resin | 95 parts |
| Nigrosine (manufactured by Orient Chemical Industries Co., Ltd. under the trade name of "EX") | 5 parts |
| "Carrier 10" | |
| Silicone resin | 99 parts |
| Mixture of nigrosine complex and sodium stearate | 1 part |
| Cu—Zn ferrite particles having an average particle diameter of 80 μm | 10,000 parts |
| "Carrier 11" | |
| Silicone resin | 99 parts |
| Mixture of nigrosine complex and sodium stearate | 1 part |
| Magnetite particles having an average particle diameter of 80 μm | 10,000 parts |
| "Carrier 12" | |
| Silicone resin | 99 parts |
| Mixture of nigrosine complex and sodium stearate | 1 part |

-continued

| | |
|---|---|
| Iron powders having an average particle diameter of 80 μm | 10,000 parts |

Example 5

Printing Test:

To evaluate printing characteristics such as fixability of the toners 1 to 31 prepared in Examples 1 and 2, a printing test was carried out in the following procedure.

The toner and the carrier 3 coated with a silicone resin prepared in Example 4 were mixed to prepare a developing agent having a toner concentration of 4.5% by weight.

After modification of a high speed printing machine (F6760D, manufactured by Fujitsu Corp.) with a built-in flash fixing device into that suitable for negatively charging toner, document patterns were continuously printed on plain paper using each developing agent described above. A process speed of the printing machine was 1,200 mm per second and the quantity of the toner consumed was about 1 kg per hour.

In the printing test using each developing agent, evaluation was carried out with respect to characteristics of the following four items. The results are shown in Tables 2 and 3 below.

(1) Fixability

The fixability of the toner was evaluated for both peelability and rubbing resistance.

(Peelability)

The fixability was evaluated from the degree of the durability to a peeling treatment of toner printing. After sticking Mending Tape (manufactured by Sumitomo 3M) on the printed surface of the printed sample while applying a load of 600 g, the tape was peeled off. After peeling off the tape, a change in printing density was measured by an optical densitometer. Prints with a change in printing density of 10% or less were rated that they have good fixability (expressed by the symbol ○ in the tables), while others were rated that they have poor fixability (expressed by the symbol x in the tables).

(Rubbing resistance)

The rubbing resistance was evaluated from the degree of the durability to a rubbing treatment of toner printing. A rubbing operation of rubbing while pressing a white paper against the printed surface of the printed sample at a force of 20 g/cm$^2$ was repeated ten times. After the completion of the rubbing operation, stain of the rubbed surface of the white paper was visually observed. Prints with no stain were rated good (○), while others were rated (×).

(2) Void Resistance

The printed surface of the printed sample was observed by an optical microscope. Prints in which voids (white dots) were not recognized were rated that they have good void resistance (○), while others were rated poor (×).

(3) Grindability of Toner

The grindability was evaluated by the quantity (average number of particles) of the toner in the form of fine particles having a diameter of 5 μm or less formed during grinding of the toner. Samples in which the number of the toner in the form of fine particles is 10% or less were rated good (○), while others were rated poor (×).

(4) Stain Resistance in Printer (Clogging of Filter of Flash Fixing Device)

After printing 100,000 sheets of paper in case of continuous printing, the state of clogging of the filter of the flash fixing device was visually observed. Prints with no clogging were rated good (○), while others were rated poor (×).

TABLE 2

| Toner component | Manufacturer | Toner 1 | Toner 2 | Toner 3 | Toner 4 | Toner 5 | Toner 6 | Toner 7 | Toner 8 | Toner 9 | Toner 10 |
|---|---|---|---|---|---|---|---|---|---|---|---|
| #25 (carbon) | Mitsubishi Chemical | 10 | 10 | 10 | 10 | 10 | 10 | 10 | 10 | 10 | 10 |
| ECR181 (magenta) | Dainichiseika Color & Chemicals Mfg. Co., Ltd. | 0 | 0 | 0 | 0 | 0 | 0 | 0 | 0 | 0 | 0 |
| KEP-S (magnetic powder) | Kanto Denka Kogyo Co., Ltd. | 0 | 0 | 0 | 0 | 0 | 0 | 0 | 0 | 0 | 0 |
| T-95 (charge controlling agent) | Hodogaya Chemical CO., Ltd. | 1 | 1 | 1 | 1 | 1 | 1 | 1 | 1 | 1 | 1 |
| Polyester resin | Kao Corp. | 84 | 84 | 84 | 84 | 84 | 85.5 | 85.5 | 85.99 | 81 | 79 |
| Chloroform-insoluble content in polyester resin | | 5 | 10 | 20 | 30 | 3 | 2 | 5 | 5 | 5 | 5 |
| Polyetherpolyol resin | Mitsui Chemicals | 0 | 0 | 0 | 0 | 0 | 0 | 0 | 0 | 0 | 0 |
| Styrene-acrylic resin | Mitsui Chemicals | 0 | 0 | 0 | 0 | 0 | 0 | 0 | 0 | 0 | 0 |
| NP105 (polypropylene resin) | Mitsui Chemicals | 2 | 2 | 2 | 2 | 2 | 0.5 | 0.5 | 0.01 | 5 | 7 |
| Ester type resin (II) | Nippon Oil & Fats Co., Ltd. | 3 | 3 | 3 | 3 | 3 | 3 | 3 | 3 | 3 | 3 |
| Ester type resin (III) | Nippon Oil & Fats Co., Ltd. | 0 | 0 | 0 | 0 | 0 | 0 | 0 | 0 | 0 | 0 |
| Ester type resin (IV) | Nippon Oil & Fats Co., Ltd. | 0 | 0 | 0 | 0 | 0 | 0 | 0 | 0 | 0 | 0 |
| Fixability | Peelability | ○ | ○ | Δ | x | ○ | ○ | Δ | x | ○ | ○ |
| | Rubbing resistance | ○ | ○ | Δ | x | ○ | ○ | ○ | ○ | ○ | ○ |
| Void resistance | | ○ | ○ | ○ | ○ | Δ | x | ○ | ○ | ○ | ○ |
| Grindability of toner | | ○ | ○ | ○ | ○ | ○ | ○ | Δ | x | ○ | ○ |
| Stain of printer (clogging of filter) | | ○ | ○ | ○ | ○ | ○ | ○ | ○ | ○ | Δ | x |

| Toner component | Manufacturer | Toner 11 | Toner 12 | Toner 13 | Toner 14 | Toner 15 | Toner 16 | Toner 17 | Toner 18 | Toner 19 | Toner 20 |
|---|---|---|---|---|---|---|---|---|---|---|---|
| #25 (carbon) | Mitsubishi Chemical | 10 | 10 | 10 | 10 | 10 | 10 | 10 | 10 | 10 | 0 |
| ECR181 (magenta) | Dainichiseika Color & Chemicals Mfg. Co., Ltd. | 0 | 0 | 0 | 0 | 0 | 0 | 0 | 0 | 0 | 10 |
| KEP-S (magnetic powder) | Kanto Denka Kogyo Co., Ltd. | 0 | 0 | 0 | 0 | 0 | 0 | 5 | 0 | 0 | 0 |
| T-95 (charge controlling agent) | Hodogaya Chemical CO., Ltd. | 1 | 1 | 1 | 1 | 1 | 1 | 1 | 1 | 1 | 0 |
| Polyester resin | Kao Corp. | 86 | 86.5 | 72 | 67 | 84 | 84 | 79 | 42 | 42 | 85 |
| Chloroform-insoluble content in polyester resin | | 5 | 5 | 5 | 5 | 5 | 5 | 10 | 10 | 10 | 5 |
| Polyetherpolyol resin | Mitsui Chemicals | 0 | 0 | 0 | 0 | 0 | 0 | 0 | 42 | 0 | 0 |
| Styrene-acrylic resin | Mitsui Chemicals | 0 | 0 | 0 | 0 | 0 | 0 | 0 | 0 | 42 | 0 |
| NP105 (polypropylene resin) | Mitsui Chemicals | 2 | 2 | 2 | 2 | 2 | 2 | 2 | 2 | 2 | 2 |
| Ester type resin (II) | Nippon Oil & Fats Co., Ltd. | 1 | 0.5 | 15 | 20 | 0 | 0 | 3 | 3 | 3 | 3 |
| Ester type resin (III) | Nippon Oil & Fats Co., Ltd. | 0 | 0 | 0 | 0 | 3 | 0 | 0 | 0 | 0 | 0 |
| Ester type resin (IV) | Nippon Oil & Fats Co., Ltd. | 0 | 0 | 0 | 0 | 0 | 3 | 0 | 0 | 0 | 0 |
| Fixability | Peelability | ○ | Δ | ○ | ○ | ○ | ○ | ○ | ○ | ○ | ○ |
| | Rubbing resistance | ○ | Δ | ○ | ○ | ○ | ○ | ○ | ○ | ○ | ○ |
| Void resistance | | Δ | Δ | ○ | ○ | ○ | | ○ | ○ | ○ | ○ |
| Grindability of toner | | ○ | ○ | ○ | x | ○ | ○ | ○ | ○ | ○ | ○ |
| Stain of printer (clogging of filter) | | ○ | ○ | Δ | x | Δ | x | ○ | ○ | ○ | ○ |

TABLE 3

| Toner component | Manufacturer | Toner 21 | Toner 22 | Toner 23 | Toner 24 | Toner 25 | Toner 26 | Toner 27 | Toner 28 | Toner 29 | Toner 30 | Toner 31 |
|---|---|---|---|---|---|---|---|---|---|---|---|---|
| #25 (carbon) | Mitsubishi Chemical | 10 | 10 | 10 | 10 | 10 | 10 | 10 | 10 | 10 | 10 | 10 |
| T-95 (charge controlling agent) | Hodogaya Chemical CO., Ltd. | 1 | 1 | 1 | 1 | 1 | 1 | 1 | 1 | 1 | 1 | 1 |
| Polyester resin | Kao Corp. | 84 | 84 | 84 | 84 | 84 | 84 | 84 | 84 | 84 | 84 | 84 |
| Chloroform-insoluble content in polyester resin | | 5 | 5 | 5 | 5 | 5 | 5 | 5 | 5 | 5 | 5 | 5 |
| NP105 (polypropylene), number-average molecular weight: 10,000 | Mitsui Chemicals | 2 | 2 | 2 | 2 | 2 | 2 | 2 | 2 | 0 | 0 | 2 |

TABLE 3-continued

| | | | | | | | | | | | | |
|---|---|---|---|---|---|---|---|---|---|---|---|---|
| Ester type resin (II) | Nippon Oil & Fats Co., Ltd. | 0 | 0 | 0 | 0 | 0 | 0 | 0 | 0 | 3 | 3 | 0 |
| Comparative Ester type resin (V) | Nippon Oil & Fats Co., Ltd. | 3 | 0 | 0 | 0 | 0 | 0 | 0 | 0 | 0 | 0 | 0 |
| Comparative Ester type resin (VI) | Nippon Oil & Fats Co., Ltd. | 0 | 3 | 0 | 0 | 0 | 0 | 0 | 0 | 0 | 0 | 0 |
| Montan wax KP302 | Clariant (Japan) K. K. | 0 | 0 | 3 | 0 | 0 | 0 | 0 | 0 | 0 | 0 | 0 |
| Montan wax OP | Clariant (Japan) K. K. | 0 | 0 | 0 | 3 | 0 | 0 | 0 | 0 | 0 | 0 | 0 |
| Polyethylene 100P, number-average molecular weight: 900 | Mitsui Chemicals | 0 | 0 | 0 | 0 | 3 | 0 | 0 | 0 | 0 | 0 | 0 |
| Toner component | Manufacturer | Toner 21 | Toner 22 | Toner 23 | Toner 24 | Toner 25 | Toner 26 | Toner 27 | Toner 28 | Toner 29 | Toner 30 | Toner 31 |
| Polyethylene PE520 | Clariant (Japan) K. K. | 0 | 0 | 0 | 0 | 0 | 3 | 0 | 0 | 0 | 0 | 0 |
| Carnauba wax | Kato Yoko K. K. | 0 | 0 | 0 | 0 | 0 | 0 | 3 | 0 | 0 | 0 | 0 |
| Amide wax 9615A | Clariant (Japan) K. K. | | 0 | 0 | 0 | 0 | 0 | 0 | 3 | 0 | 0 | 0 |
| 550P (polypropylene), number-average molecular weight: 4,000 | Sanyo Chemical Ind. | 0 | 0 | 0 | 0 | 0 | 0 | 0 | 0 | 2 | 0 | 0 |
| 660P (polypropylene), number-average molecular weight: 3,000 | Sanyo Chemical Ind. | 0 | 0 | 0 | 0 | 0 | 0 | 0 | 0 | 0 | 2 | 0 |
| Polyethylene 800P, number-average molecular weight: 8,000 | Mitsui Chemicals | 0 | 0 | 0 | 0 | 0 | 0 | 0 | 0 | 0 | 0 | 3 |
| Fixability | Peelability | ○ | x | ○ | ○ | ○ | ○ | ○ | x | ○ | ○ | ○ |
| | Rubbing resistance | ○ | x | ○ | ○ | ○ | ○ | x | x | ○ | ○ | ○ |
| Void resistance | | ○ | ○ | ○ | ○ | ○ | ○ | ○ | ○ | ○ | ○ | ○ |
| Grindability of toner | | x | x | x | x | x | x | ○ | ○ | ○ | ○ | ○ |
| Stain of printer (clogging of filter) | | x | ○ | x | x | x | x | x | x | x | x | x |

As is apparent from the results described in Tables 2 and 3, according to the present invention, an electrophotographic toner capable of realizing excellent printing characteristics in a flash fixing system can be obtained.

Example 6

Continuous Printing Test:

To evaluate printing characteristics of the resin-coated toners 1 to 12 prepared in Examples 3 and 4, a continuous printing test was carried out in the following procedure.

The toner 1 prepared in Example 1 and each of the resin-coated carriers 1 to 12 were mixed to prepare a developing agent having a toner concentration of 4.5% by weight. After modification of a high sped printing machine (F6760D, manufactured by Fujitsu Corp.) with a built-in flash fixing device into that suitable for negatively charging toner, document patterns were continuously printed on plain paper using each developing agent described above. A process speed of the printing machine was 1,200 mm per second and the quantity of the toner consumed was about 1 kg per hour.

In the printing test using each toner, evaluation was carried out with respect to characteristics of the following six items. The results are shown in Table 4 below.

(1) Initial Printing

The printing state of the resulting printed sample was visually observed at an initial stage of printing. Prints in which satisfactory printing was carried out were rated good (○), while others were rated poor (×).

(2) Deposition of Carrier

To evaluate stain of the printer, it was visually observed whether the carrier is deposited in the printer. Samples in which any deposition was not recognized were rated good (○), while others were rated poor (×).

(3) Life of Carrier

Continuous printing was carried out and the number of sheets (unit: ten thousand sheets) achieved up to the life of the carrier was recorded.

(4) Problems during Life

Continuous printing was carried out up to the life of the carrier, and then the state of the printing density and that of fog were observed and recorded.

(5) Initial Charge Quantity of Carrier

An initial charge quantity ($\mu$C/g) of the carrier was measured and recorded.

(6) Charge Quantity during Life of Carrier

A charge quantity ($\mu$C/g) during the life of the carrier was measured and recorded.

TABLE 4

| Carrier component | Manufacturer | Carrier 1 | Carrier 2 | Carrier 3 | Carrier 4 | Carrier 5 | Carrier 6 |
|---|---|---|---|---|---|---|---|
| Silicone resin (SR2411) | TORAY DOW CORNING SILICONE CO., LTD. | 99.9 | 99.5 | 99 | 98 | 95 | 100 |

TABLE 4-continued

| | | | | | | | |
|---|---|---|---|---|---|---|---|
| Nigrosine complex-stearic acid mixture (N-11) | Orient Chemical Industries Co., Ltd. | 0.1 | 0.5 | 1 | 2 | 5 | — |
| Nigrosine (EX) | Orient Chemical Industries Co., Ltd. | — | — | — | — | — | — |
| Mn—Sr ferrite (80 μm) | Powdertech Co., Ltd. | 10000 | 10000 | 10000 | 10000 | 10000 | 10000 |
| Copper-zinc ferrite (80 μm) | Powdertech Co., Ltd. | — | — | — | — | — | — |
| Mgnetite (80 μm) | Powdertech Co., Ltd. | — | — | — | — | — | — |
| Iron content (80 μm) | Powdertech Co., Ltd. | — | — | — | — | — | — |
| Initial printing | | ○ | ○ | ○ | ○ | ○ | ○ |
| Deposition of carrier | | ○ | ○ | ○ | ○ | ○ | ○ |
| Life of carrier (ten thousand sheets) | | 30 | 80 | ≧100 | 80 | 20 | 10 |
| Problem during life | | reduction of printing density | reduction of printing density | none | fogging | fogging | reduction of printing density |
| Initial charge quantity (μC/g) | | 20 | 21 | 19 | 18 | 20 | 23 |
| Initial charge quantity during life (μC/g) | | 35 | 30 | 20 | 14 | 12 | 45 |

| Carrier component | Manufacturer | Carrier 1 | Carrier 2 | Carrier 3 | Carrier 4 | Carrier 5 | Carrier 6 |
|---|---|---|---|---|---|---|---|
| Silicone resin (SR2411) | TORAY DOW CORNING SILICONE CO., LTD. | 99 | 99.5 | 95 | 99 | 99 | 99 |
| Nigrosine complex-stearic acid mixture (N-11) | Orient Chemical Industries Co., Ltd. | — | — | — | 1 | 1 | 1 |
| Nigrosine (EX) | Orient Chemical Industries Co., Ltd. | 1 | 0.5 | 5 | — | — | — |
| Mn—Sr ferrite (80 μm) | Powdertech Co., Ltd. | 10000 | 10000 | 10000 | — | — | — |
| Copper-zinc ferrite (80 μm) | Powdertech Co., Ltd. | — | — | — | 10000 | — | — |
| Mgnetite (80 μm) | Powdertech Co., Ltd. | — | — | — | — | 10000 | — |
| Iron content (80 μm) | Powdertech Co., Ltd. | — | — | — | — | — | 10000 |
| Initial printing | | ○ | ○ | ○ | ○ | x (brush-like striation) | x (brush-like striation) |
| Deposition of carrier | | ○ | ○ | ○ | x | ○ | ○ |
| Life of carrier (ten thousand sheets) | | 20 | 20 | 20 | — | — | — |
| Problem during life | | reduction of printing density | reduction of printing density | fogging | — | — | — |
| Initial charge quantity (−μC/g) | | 22 | 23 | 25 | 19 | 23 | 21 |
| Initial charge quantity during life (−μC/g) | | 43 | 36 | 12 | — | — | — |

As is apparent from the results described in Table 4, when using a specific carrier coated with a silicone resin prepared according to the present invention, excellent continuous printing results can be obtained as compared with the case of using a conventional resin-coated carrier.

In case of the resin-coated carrier using magnetite or iron powders having a high carrier magnetic force as a core material, striation (brush-like striation) occurred in the print and satisfactory printing could not be carried out at an initial stage. In case of the resin-coated carrier using copper-zinc ferrite as a core material, since missing of the toner was caused in the printing area by deposition of the carrier, satisfactory printing could not be carried out at an initial stage.

On the contrary, when using the resin-coated carrier using a coating agent prepared by adding a mixture of a nigrosine complex and sodium stearate to a silicone resin, a change in charge quantity with a lapse of time did not occur as shown in Table 4 and, therefore, stable printing could be realized for a long period.

Example 7

Preparation of Binder Resins 1 to 13:

As described in Table 5 below, a propylene oxide adduct of bisphenol A or an ethylene oxide adduct of bisphenol A (as an alcohol component), terephthalic acid or isophthalic acid (as an acid component) and trimellitic acid (as a crosslinking component) were charged in a glass flask, together with any one of the ester components which contain different esterifying catalysts and have different molecular weight distributions, reacted at 220° C. for three hours and 240° C. for three hours, and then reacted at the same temperature (240° C.) under reduced pressure for two hours to prepare thirteen kinds of binder resins. The molecular weight distribution of the ester components (1) to (5) used in this example was determined from a ratio of a peak height using a mass spectrograph (manufactured by JEOL Ltd. under the trade name of "SX102A"). As a result, they had the molecular weight distribution as summarized in Table 6 below.

TABLE 5

| Components | Binder resin 1 | Binder resin 2 | Binder resin 3 | Binder resin 4 | Binder resin 5 | Binder resin 6 | Binder resin 7 |
|---|---|---|---|---|---|---|---|
| Chloroform-insoluble content in polyester resin | 10 | 3 | 20 | 0 | 25 | 10 | 10 |
| Internally-additive ester (1) | 2 | 2 | 2 | 2 | 2 | 0.1 | 10 |
| Internally-additive ester (2) | 0 | 0 | 0 | 0 | 0 | 0 | 0 |
| Internally-additive ester (3) | 0 | 0 | 0 | 0 | 0 | 0 | 0 |
| Internally-additive ester (4) | 0 | 0 | 0 | 0 | 0 | 0 | 0 |
| Internally-additive ester (5) | 0 | 0 | 0 | 0 | 0 | 0 | 0 |

| Components | Binder resin 8 | Binder resin 9 | Binder resin 10 | Binder resin 11 | Binder resin 12 | Binder resin 13 |
|---|---|---|---|---|---|---|
| Chloroform-insoluble content in polyester resin | 10 | 10 | 10 | 10 | 10 | 10 |
| Internally-additive ester (1) | 0 | 15 | 0 | 0 | 0 | 0 |
| Internally-additive ester (2) | 0 | 0 | 2 | 0 | 0 | 0 |
| Internally-additive ester (3) | 0 | 0 | 0 | 2 | 0 | 0 |
| Internally-additive ester (4) | 0 | 0 | 0 | 0 | 2 | 0 |
| Internally-additive ester (5) | 0 | 0 | 0 | 0 | 0 | 2 |

TABLE 6

| Molecular weight | Internally-additive ester (1) | Internally-additive ester (2) | Internally-additive ester (3) | Internally-additive ester (4) | Internally-additive ester (5) |
|---|---|---|---|---|---|
| Low-molecular weight range | 1250–1390 | 1050–1200 | 1500–1970 | 800–1000 | 800–1200 |
| Ionization efficiency (%) | 30 | 35 | 30 | 35 | 50 |
| Highest peak site | 1390–1450 | 1200–1250 | 1970–2070 | 1000–1050 | 1200–1250 |
| Ionization efficiency (%) | 60 | 45 | 55 | 55 | 35 |
| High-molecular weight range | 1450–1550 | 1250–1400 | 2070–2200 | 1050–1300 | 1250–1500 |
| Ionization efficiency (%) | 10 | 20 | 15 | 10 | 15 |

Example 8

Preparation of Toner 32:

As described in Table 7 below, the following toner components were prepared in the amount described below.

| | | |
|---|---|---|
| Binder resin 1 (prepared in Example 7) | | 87 parts |
| Polypropylene resin (weight-average molecular weight: 10,000, manufactured by Mitsui Chemicals under the trade name of "NP105") | | 1 part |
| Colorant | Carbon (#25, manufactured by Mitsubishi Chemical) | 10 parts |
| Charge controlling agent | Sulfonic acid polymer (manufactured by Orient Chemical Industries Co., Ltd. under the trade name of "N-01") | 2 parts |

These toner components were preliminary mixed by charging in a ball mill and then the mixture was melted and kneaded in an extruder heated to 160° C. After cooling the kneaded mixture to solidify it, the solid mixture was ground by a hammer mill and then ground into fine powder in a jet mill. The fine powder thus obtained was classified by an air flow classifier, thereby to obtain black fine spherical particles having a volume-average particle diameter of 8.5 μm. To the fine particles of toner thus obtained, 1.5 parts by weight of hydrophobic fine silica particles (manufactured by Clariant Japan Co., Ltd. under the trade name of "H2000/4") were externally added in a Henschel mixer. As a result, an yellow toner in the form of fine spherical particles having an average particle diameter of 8.5 μm. The resulting toner in the form of fine spherical particles is referred to as "toner 32", hereinafter. Preparation of toners 33 to 55:

As described in Table 7 below, twenty-three kinds of toners in the form of spherical fine powders were prepared in the same manner as in case of preparation of the toner 32, except that combinations and amounts of the toner components were changed. The "ester (1)" described in the column of "toner components" is a polyester resin which was derived from the ester component (1), added as the ester type resin.

Example 9

Preparation of Carrier 13:

Manganese-strontium (Mn—Sr) ferrite particles having an average particle diameter of 80 μm (manufactured by Powdertech Co., Ltd.) as a carrier core material were prepared and then the surface of this core material was coated with a silicone resin (solid content: 20% by weight, manufactured by TORAY DOW CORNING SILICONE CO., LTD. under the trade name of "SR2411") in a coating weight of 0.1% by weight using a fluidized bed. After the completion of coating, the coated core material was baked at a temperature of 250° C. for three hours. As a result, a Mn—Sr ferrite carrier coated with a silicone resin was obtained. The resulting carrier is referred to as "carrier 13", hereinafter.

Example 10

Printing Test:

To evaluate printing characteristics such as the fixability of the toners 32 to 55 prepared in Example 8, a printing test was carried out in the same procedure as in the printing test described in Example 5.

The toner and the carrier 13 coated with a silicone resin prepared in Example 9 were mixed to prepare developing agents 32 to 55 having a toner concentration of 4.5% by weight (see, Table 7 below).

After modification of a high speed printing machine (F6760D, manufactured by Fujitsu Corp.) with a built-in flash fixing device into that suitable for a negatively charging toner, document patterns were continuously printed on plain paper using each developing agent described above. A process speed of the printing machine was 1,200 mm per second and the quantity of the toner consumed was about 1 kg per hour.

In the printing test using each developing agent, evaluation was carried out with respect to characteristics of the following four items. The results are shown in Table 7 below.

(1) Fixability (Peelability)

The fixability was evaluated from the degree of the durability to a peeling treatment of toner printing. After sticking Mending Tape (manufactured by Sumitomo 3M) on the printed surface of the printed sample while applying a load of 600 g, the tape was peeled off. After peeling off the tape, a change in printing density was measured by an optical densitometer. Prints with a change in printing density of 15% or less were rated that they have permissible fixability (expressed by the symbol Δ in the tables), prints with a change in printing density of 10% or less were rated that they have good fixability (○), prints with a change in printing density of 5% or less were rated that they have excellent fixability (◎), and others were rated poor (×).

(2) Void Resistance

The printed surface of the printed sample was observed by an optical microscope. Prints in which slight voids (white dots) were recognized were rated that they have permissible void resistance (Δ), prints in which voids were not recognized were rated that they have good fixability (○), and others were rated poor (×).

(3) Grindability of Toner

The grindability was evaluated by the quantity (average number of particles) of the toner in the form of fine particles having a diameter of 5 μm or less formed during grinding of the toner. Samples in which the number of the toner in the form of fine particles is 15% or less were rated pass (Δ), samples in which the number of the toner in the form of fine particles is 10% or less were rated good (○), and others were rated poor (×).

(4) Printer Stain Resistance (Clogging of Filter of Flash Fixing Device)

After printing 100,000 sheets of paper by continuous printing, the state of clogging of the filter of the flash fixing device was visually observed. Prints with slight clogging were rated pass (Δ), prints with no clogging were rated good (○), and others were rated poor (×).

TABLE 7

| Toner component | Manufacturer | Toner 32 | Toner 33 | Toner 34 | Toner 35 | Toner 36 | Toner 37 | Toner 38 | Toner 39 |
|---|---|---|---|---|---|---|---|---|---|
| Binder resin | Kao Corp. | Binder resin 1 87 | Binder resin 2 87 | Binder resin 3 87 | Binder resin 4 87 | Binder resin 5 87 | Binder resin 6 87 | Binder resin 7 87 | Binder resin 8 87 |
| | Kao Corp. | | | | | | | | |
| #25 (carbon) | Mitsubishi Chemical | 10 | 10 | 10 | 10 | 10 | 10 | 10 | 10 |
| N-01 (charge controlling agent) | Orient Chemical Industries Co., Ltd. | 2 | 2 | 2 | 2 | 2 | 2 | 2 | 2 |
| NP 105 (polypropylene) | Mitsui Chemicals | 1 | 1 | 1 | 1 | 1 | 1 | 1 | 1 |
| Carnauba wax | Kato Yoko K. K. | 0 | 0 | 0 | 0 | 0 | 0 | 0 | 0 |
| 550P (polypropylene) | Sanyo Chemical Ind. | 0 | 0 | 0 | 0 | 0 | 0 | 0 | 0 |
| 660P (polypropylene) | Sanyo Chemical Ind. | 0 | 0 | 0 | 0 | 0 | 0 | 0 | 0 |
| Ester (1) | Nippon Oil & Fats Co., Ltd. | 0 | 0 | 0 | 0 | 0 | 0 | 0 | 0 |
| Developing agent | | Developing agent 32 | Developing agent 33 | Developing agent 34 | Developing agent 35 | Developing agent 36 | Developing agent 37 | Developing agent 38 | Developing agent 39 |
| Toner concentration | | 4.5% | 4.5% | 4.5% | 4.5% | 4.5% | 4.5% | 4.5% | 4.5% |
| Fixability | Peelability | ○ | ○ | Δ | ○ | Δ | Δ | ◎ | x |
| Void resistance | | ○ | Δ | ○ | x | ○ | ○ | ○ | ○ |
| Grindability of toner | | ○ | ○ | Δ | ○ | x | ○ | ○ | ○ |
| Stain of printer (clogging of filter) | | ○ | ○ | ○ | ○ | ○ | ○ | Δ | ○ |

| Toner component | Manufacturer | Toner 40 | Toner 41 | Toner 42 | Toner 43 | Toner 44 | Toner 45 | Toner 46 | Toner 47 |
|---|---|---|---|---|---|---|---|---|---|
| Binder resin | Kao Corp. | Binder resin 8 85 | Binder resin 8 77 | Binder resin 9 87 | Binder resin 9 20 | Binder resin 10 87 | Binder resin 11 87 | Binder resin 12 87 | Binder resin 13 87 |
| | Kao Corp. | | | | Binder resin 8 67 | | | | |
| #25 (carbon) | Mitsubishi Chemical | 10 | 10 | 10 | 10 | 10 | 10 | 10 | 10 |
| N-01 (charge controlling agent) | Orient Chemical Industries Co., Ltd. | 2 | 2 | 2 | 2 | 2 | 2 | 2 | 2 |
| NP 105 (polypropylene) | Mitsui Chemicals | 1 | 1 | 1 | 1 | 1 | 1 | 1 | 1 |
| Carnauba wax | Kato Yoko K. K. | 0 | 0 | 0 | 0 | 0 | 0 | 0 | 0 |
| 550P (polypropylene) | Sanyo Chemical Ind. | 0 | 0 | 0 | 0 | 0 | 0 | 0 | 0 |
| 660P (polypropylene) | Sanyo Chemical Ind. | 0 | 0 | 0 | 0 | 0 | 0 | 0 | 0 |

TABLE 7-continued

| | | | | | | | | | |
|---|---|---|---|---|---|---|---|---|---|
| Ester (1) | Nippon Oil & Fats Co., Ltd. | 2 | 10 | 0 | 0 | 0 | 0 | 0 | 0 |
| Developing agent | | Developing agent 40 | Developing agent 41 | Developing agent 42 | Developing agent 43 | Developing agent 44 | Developing agent 45 | Developing agent 46 | Developing agent 47 |
| Toner concentration | | 4.5% | 4.5% | 4.5% | 4.5% | 4.5% | 4.5% | 4.5% | 4.5% |
| Fixability | Peelability | ○ | ◎ | ◎ | ○ | ○ | Δ | ○ | ○ |
| Void resistance | | ○ | ○ | ○ | ○ | ○ | ○ | ○ | ○ |
| Grindability of toner | | ○ | ○ | ○ | ○ | ○ | ○ | ○ | ○ |
| Stain of printer (clogging of filter) | | ○ | Δ | x | ○ | Δ | ○ | x | x |
| Toner component | Manufacturer | Toner 48 | Toner 49 | Toner 50 | Toner 51 | Toner 52 | Toner 53 | Toner 54 | Toner 55 |
| Binder resin | Kao Corp. | Binder resin 6 85 | Binder resin 2 87.9 | Binder resin 2 83 | Binder resin 2 78 | Binder resin 2 87 | Binder resin 2 87 | Binder resin 2 87 | Binder resin 2 87 |
| | Kao Corp. | | | | | | | | |
| #25 (carbon) | Mitsubishi Chemical | 10 | 10 | 10 | 10 | 10 | 10 | 10 | 10 |
| N-01 (charge controlling agent) | Orient Chemical Industries Co., Ltd. | 2 | 2 | 2 | 2 | 2 | 2 | 2 | 2 |
| NP 105 (polypropylene) | Mitsui Chemicals | 1 | 0.1 | 5 | 0 | 10 | 0 | 0 | 0 |
| Carnauba wax | Kato Yoko K. K. | 0 | 0 | 0 | 0 | 0 | 1 | 0 | 0 |
| 550P (polypropylene) | Sanyo Chemical Ind. | 0 | 0 | 0 | 0 | 0 | 0 | 1 | 0 |
| 660P (polypropylene) | Sanyo Chemical Ind. | 0 | 0 | 0 | 0 | 0 | 0 | 0 | 1 |
| Ester (1) | Nippon Oil & Fats Co., Ltd. | 2 | 0 | 0 | 0 | 0 | 0 | 0 | 0 |
| Developing agent | | Developing agent 48 | Developing agent 49 | Developing agent 50 | Developing agent 51 | Developing agent 52 | Developing agent 53 | Developing agent 54 | Developing agent 55 |
| Toner concentration | | 4.5% | 4.5% | 4.5% | 4.5% | 4.5% | 4.5% | 4.5% | 4.5% |
| Fixability | Peelability | ○ | Δ | ○ | Δ | ◎ | ◎ | ○ | ○ |
| Void resistance | | ○ | ○ | ○ | ○ | ○ | ○ | ○ | ○ |
| Grindability of toner | | ○ | Δ | ○ | x | ○ | ○ | ○ | ○ |
| Stain of printer (clogging of filter) | | ○ | ○ | Δ | ○ | x | x | Δ | x |

Example 11

Continuous Printing Test:

To evaluate lifetime characteristics of the developing agents 32, 37 to 43 and 46 prepared in Example 8, a continuous printing test was carried out using the following procedure.

The toner corresponding to each developing agent and the resin-coated carrier 13 were mixed to prepare a developing agent having a toner concentration of 4.5% by weight. After modification of a high sped printing machine (F6760D, manufactured by Fujitsu Corp.) with a built-in flash fixing device into that suitable for negatively charging toner, document patterns were continuously printed on plain paper using each developing agent prepared described above. A process speed of the printing machine was 1,200 mm per second and the quantity of the toner consumed was about 1 kg per hour.

In the printing test using each toner, evaluation was carried out with respect to characteristics of the following five items. The results are shown in Table 8 below.

(1) Life of Carrier

Continuous printing was carried out and the number of sheets (unit: ten thousand sheets) achieved during the life was recorded. The life was evaluated depending on the time when a change in charge quantity is reduced to half of an initial value.

(2) Judgment of Life

The life was judged depending on the number of sheets achieved during the life of the developing agent. Samples in which the life of the developing agent is 1,500,000 or more were rated excellent (◎), samples in which the life of the developing agent is 1,000,000 or more were rated excellent (○), and others were rated (×).

(3) Problems During Life

Continuous printing was carried out up to the life, and then the state of the printing density and that of fogging during the life were observed and recorded.

(4) Initial Charge Quantity of Carrier

An initial charge quantity ($\mu$C/g) of the carrier was measured and recorded.

(5) Charge Quantity during the Life of Carrier

A charge quantity ($\mu$C/g) during the life of the carrier was measured and recorded.

TABLE 8

| Developing agent | Developing agent 32 | Developing agent 37 | Developing agent 38 | Developing agent 39 | Developing agent 40 | Developing agent 41 | Developing agent 42 | Developing agent 43 | Developing agent 46 |
|---|---|---|---|---|---|---|---|---|---|
| Toner concentration | 4.5% | 4.5% | 4.5% | 4.5% | 4.5% | 4.5% | 4.5% | 4.5% | 4.5% |
| Life of carrier (sheets) | ≧1,500,000 | ≧1,500,000 | 1,200,000 | ≧1,500,000 | 1,100,000 | 600,000 | 900,000 | ≧1,500,000 | 1,400,000 |
| Judgment of life | ◎ | ◎ | ○ | ◎ | ○ | x | x | ◎ | ○ |

TABLE 8-continued

| Developing agent | Developing agent 32 | Developing agent 37 | Developing agent 38 | Developing agent 39 | Developing agent 40 | Developing agent 41 | Developing agent 42 | Developing agent 43 | Developing agent 46 |
|---|---|---|---|---|---|---|---|---|---|
| Problem during life | — | — | fogging | — | fogging | fogging | fogging | — | fogging |
| Initial charge quantity (μC/g) | 20 | 21 | 22 | 20 | 19 | 19 | 20 | 21 | 21 |
| Initial charge quantity during life (μC/g) | 18 | 18 | 13 | 17 | 10 | 9 | 10 | 17 | 13 |

As is apparent from the results described in Tables 7 and 8, if the ester component is introduced in the molecule of the polyester resin according to the present invention, the fixability and void resistance are effectively improved, however, the life tends to be short as compared with the case where no ester component is introduced. The reason of this tendency is as follows. That is, it is difficult to disperse the ester component in the preparation of the toner because of a small molecular weight of the ester component and poor compatibility with the polyester resin, resulting in filming to the carrier. Therefore, it can be confirmed that the addition (internal addition) of the ester component in the polyester resin is effective for prolongation of the life. This is because the dispersibility is improved by an improvement in compatibility with the polyester resin, thereby to effectively prevent filming of the carrier.

INDUSTRIAL APPLICABILITY

As described above, the electrophotographic toner of the present invention can realize excellent fixing strength of the toner and prevent the occurrence of voids peculiar to flash fixation and the occurrence of fuming and odor during the fixation, and also which can be prepared in an efficient and stable manner without causing stain of a printing apparatus and clogging of a desmoking/deodorizing filter due to sublimation of a toner component and is stable for a long period. This electrophotographic toner is best suited for use in an electrophotographic process employing a flash fixing system. When using the toner of the present invention, fuming occurred in case of flash fixation using a conventional toner can be prevented and, therefore, it is made possible to eliminate an unpleasantness, such as an odor generated on fuming, and to eliminate a complicated operation such as the replacement of the filter.

What is claimed is:

1. An electrophotographic toner comprising a binder resin and a colorant, which is used in electrophotographic process employing a flash fixing system for fixation of a transferred toner image, wherein the binder resin is a polyester resin which partially contains a chloroform-insoluble content;

the toner contains a polypropylene resin and an ester component represented by the following formula (I):

(I)

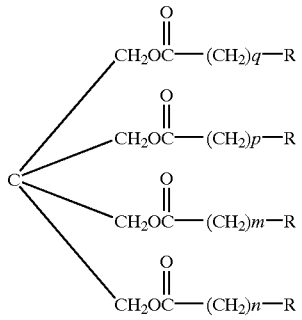

wherein p, q, m and n each represents a positive integer of 16 to 22 and R may be the same or different and each represents a hydrogen atom or a lower alkyl group having 1 to 4 carbon atoms, and the ester component (I) contains, as a principal component, a component which has a molecular weight distribution within a range from 1,200 to 1,500 in a molecular weight distribution as determined by mass spectrometric analysis and also has one peak in the range, while an ionization efficiency of a component having a molecular weight within a range from 1,420 to 1,430 is 45% or more and an ionization efficiency of a component having a molecular weight of 1,350 or less is 10% or more.

2. An electrophotographic toner according to claim 1, wherein the ester component (I) is represented by the following formula (II):

(II)

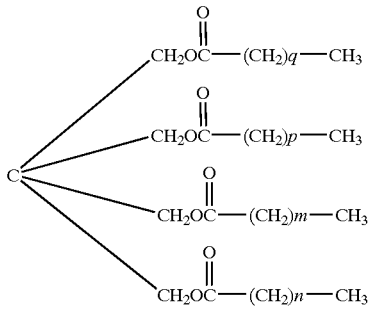

wherein p, q, m and n are as defined above, and the ester component has a weight-average molecular weight within a range from 1,350 to 1,450.

3. An electrophotographic toner according to claim 1, wherein the number-average molecular weight of the polypropylene resin is 5,000 or more.

4. An electrophotographic toner according to claim 1, which contains the chloroform-insoluble content of the polyester resin in the amount within a range from 50 to 95% by weight based on the total weight of the toner, the polypropylene resin in the amount within a range from 0.1 to 5% by weight based on the total weight of the toner, and the ester component in the amount within a range from 0.5 to 15% by weight based on the total weight of the toner.

5. A method of forming an image by means of an electrophotographic process which comprises the steps of forming an electrostatic latent image by image exposure, visualizing the electrostatic latent image by development, transferring the visualized image onto the recording medium and fixing the transferred image, wherein a developing agent containing the electrophotographic toner of any one of claims 1 to 3 and 4 is used in the step of developing the electrostatic latent image; and a flash fixing system is used as the toner fixing system in the step of fixing the toner image after transferring the toner image, which has been visualized by the use of the developing agent, onto the recording medium.

6. An image forming method according to claim 5, wherein the developing agent is a two-component developing agent and contains a combination of the electrophotographic toner and a carrier prepared by coating the surface of a core material with a resin.

7. An image forming method according to claim 6, wherein the resin-coated carrier contains doped manganese and/or doped strontium as a carrier core material and the surface of the carrier is coated with a coating agent containing a silicone resin as a principal component.

8. An image forming method according to claim 5, wherein the energy of the flashtube is within a range from 0.5 to 3.0 J/cm$^2$ and the duration of the flash is within a range from 500 to 3,000 $\mu$s in the flash fixing step.

9. An electrophotographic toner comprising a binder resin and a colorant, which is used in electrophotographic process employing a flash fixing system for fixation of a transferred toner image, wherein the binder resin is a polyester resin which contains an ester component represented by the following formula (XI):

(XI)

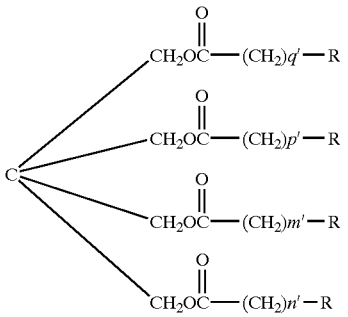

wherein p', q', m' and n' each represents a positive integer of 16 to 30 and R may be the same or different and each represents a hydrogen atom or a lower alkyl group having 1 to 4 carbon atoms, and contains at least a chloroform-insoluble content;

said polyester resin contains the ester component (XI) in the amount within a range from 0.1 to 10% by weight based on the total weight of the toner and the chloroform-insoluble content in the amount within a range from 3 to 20% by weight based on the total weight of the toner; and the toner optionally contains an ester component represented by the above formula (XI).

10. An electrophotographic toner according to claim 9, wherein the ester component (XI) is represented by the following formula (XII):

(XII)

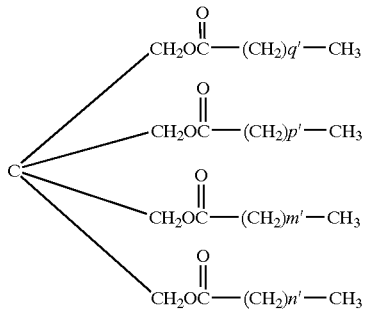

wherein p', q', m' and n' are as defined above, and has a weight-average molecular weight within a range from 1,200 to 2,200.

11. An electrophotographic toner according to claim 10, wherein the ester component (XII) is represented by the following formula (XIII):

(XIII)

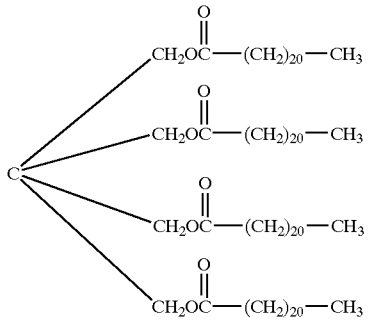

12. An electrophotographic toner according to claim 9, wherein the ester component (XI) is introduced in the step of polymerizing the polyester resin.

13. An electrophotographic toner according to claim 9, wherein in said polyester resin, the ester component (XI) contains, as a principal component, a component which has a molecular weight distribution within a range from 1,200 to 2,200 in a molecular weight distribution as determined by mass spectrometric analysis and also has at least one maximum peak in the range, while an ionization efficiency of the maximum peak is 45% or more based on the entire component.

14. An electrophotographic toner according to any one of claims 9 to 12 and 13, which contains a polypropylene resin in the amount within a range from 0.1 to 5% by weight based on the total weight of the toner.

15. An electrophotographic toner according to claim 14, wherein the number-average molecular weight of the polypropylene resin is 5,000 or more.

16. An electrophotographic toner comprising a binder resin and a colorant, which is used in electrophotographic process employing a flash fixing system for fixation of a transferred toner image, wherein the binder resin is a polyester resin which contains an ester component represented by the following formula (XI):

(XI)

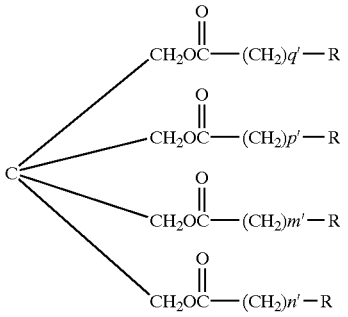

wherein p', q', m' and n' each represents a positive integer of 16 to 30 and R may be the same or different and each represents a hydrogen atom or a lower alkyl group having 1 to 4 carbon atoms, and contains at least a chloroform-insoluble content;

said polyester resin contains the ester component (XI) in the amount within a range from 0.1 to 10% by weight based on the total weight of the toner and the chloroform-insoluble content in the amount within a range from 3 to 20% by weight based on the total weight of the toner;

the polyester resin contains at least a resin containing the ester component of the formula (XI) in the amount of 10% by weight or more; and the toner optionally contains an ester component represented by the formula (XI).

17. A method of forming an image by means of an electrophotographic process which comprises the steps of forming an electrostatic latent image by image exposure, visualizing the electrostatic latent image by development, transferring the visualized image onto the recording medium and fixing the transferred image, wherein a developing agent containing the electrophotographic toner of claim 9 is used in the step of developing the electrostatic latent image; and a flash fixing system is used as the toner fixing system in the step of fixing the toner image after transferring the toner image, which has been visualized by the use of the developing agent, onto the recording medium.

18. An image forming method according to claim 17, wherein the developing agent is a two-component developing agent and contains a combination of the electrophotographic toner and a carrier prepared by coating the surface of a core material with a resin.

19. An image forming method according to claim 18, wherein the resin-coated carrier contains doped manganese and/or doped strontium as a carrier core material and the surface of the carrier is coated with a coating agent containing a silicone resin as a principal component.

20. An image forming method according to any one of claims 17 to 19, wherein the energy of the flashtube is within a range from 0.5 to 3.0 J/cm$^2$ and duration of the flashlight is within a range from 500 to 3,000 $\mu$s in the flash fixing step.

21. An electrophotographic toner comprising a binder resin and a colorant, which is used in electrophotographic process employing a flash fixing system for fixation of a transferred toner image, wherein the binder resin is a polyester resin which partially contains a chloroform-insoluble content, the toner contains a polypropylene resin and an ester component represented by the following formula (I):

(I)

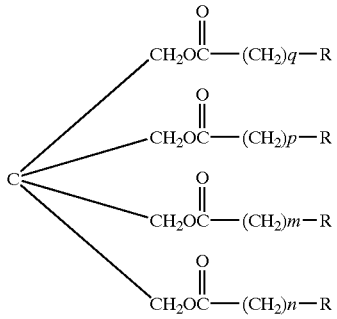

wherein p, q, m and n each represents a positive integer of 16 to 22 and R may be the same or different and each represents a hydrogen atom or a lower alkyl group having 1 to 4 carbon atoms, and wherein the toner contains the chloroform-insoluble content of the polyester resin in the amount within a range from 50 to 95% by weight based on the total weight of the toner, the polypropylene resin in the amount within a range from 0.1 to 5% by weight based on the total weight of the toner, and the ester component in the amount within a range from 0.5 to 15% by weight based on the total weight of the toner.

22. An electrophotographic toner comprising a binder resin and a colorant, which is used in electrophotographic process employing a flash fixing system for fixation of a transferred toner image, wherein the binder resin is a polyester resin which contains an ester component represented by the following formula (XI):

(XI)

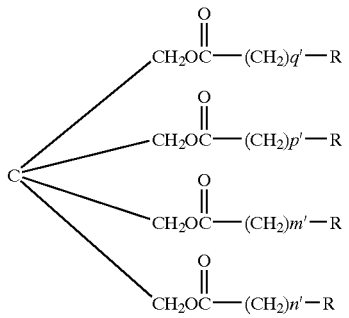

wherein p', q', m' and n' each represents a positive integer of 16 to 30 and R may be the same or different and each represents a hydrogen atom or a lower alkyl group having 1 to 4 carbon atoms, and contains at least a chloroform-insoluble content, the toner optionally contains an ester component represented by the above formula (XI), and in said polyester resin, the ester component (XI) contains, as a principal component, a component which has a molecular weight distribution within a range from 1,200 to 2,200 in a molecular weight distribution as determined by mass spectrometric analysis and also has at least one maximum peak in the range, while an ionization efficiency of the maximum peak is 45% or more based on the entire component.

* * * * *